US007585205B2

(12) United States Patent
Katsuoka et al.

(10) Patent No.: US 7,585,205 B2
(45) Date of Patent: Sep. 8, 2009

(54) SUBSTRATE POLISHING APPARATUS AND METHOD

(75) Inventors: Seiji Katsuoka, Tokyo (JP); Masahiko Sekimoto, Tokyo (JP); Junji Kunisawa, Tokyo (JP); Mitsuru Miyazaki, Tokyo (JP); Teruyuki Watanabe, Tokyo (JP); Kenichi Kobayashi, Tokyo (JP); Masayuki Kumekawa, Tokyo (JP); Toshio Yokoyama, Tokyo (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 11/905,687

(22) Filed: Oct. 3, 2007

(65) Prior Publication Data

US 2008/0085658 A1 Apr. 10, 2008

(30) Foreign Application Priority Data

Oct. 6, 2006 (JP) ..... 2006-275857
Aug. 31, 2007 (JP) ..... 2007-225805

(51) Int. Cl.
*B24B 49/00* (2006.01)

(52) U.S. Cl. ..... 451/9; 451/11; 451/287; 451/331; 451/339; 451/443; 451/446; 451/449; 451/914

(58) Field of Classification Search ..... 451/9, 451/10, 11, 41, 285, 287, 331, 334, 339, 451/443, 446, 449, 914
See application file for complete search history.

(56) References Cited

U.S. PATENT DOCUMENTS

| | | | | |
|---|---|---|---|---|
| 5,094,037 | A * | 3/1992 | Hakomori et al. | 451/11 |
| 6,332,826 | B1 * | 12/2001 | Katsuoka et al. | 451/5 |
| 2005/0260933 | A1 * | 11/2005 | Kimura et al. | 451/44 |
| 2007/0113977 | A1 * | 5/2007 | Hongo et al. | 156/345.31 |
| 2008/0038993 | A1 * | 2/2008 | Jeong | 451/11 |
| 2008/0166949 | A1 * | 7/2008 | Yajima et al. | 451/11 |
| 2008/0188167 | A1 * | 8/2008 | Ishii et al. | 451/307 |
| 2008/0200100 | A1 * | 8/2008 | Takahashi et al. | 451/44 |

FOREIGN PATENT DOCUMENTS

| | | | |
|---|---|---|---|
| JP | 09193003 | A * | 7/1997 |
| JP | 2004-268155 | | 9/2004 |
| JP | 2004-276133 | | 10/2004 |

* cited by examiner

*Primary Examiner*—Eileen P. Morgan
(74) *Attorney, Agent, or Firm*—Wenderoth, Lind & Ponack, L.L.P.

(57) ABSTRACT

A substrate polishing apparatus includes a substrate holding mechanism having a head for holding a substrate to be polished, and a polishing mechanism including a polishing table with a polishing pad mounted thereon. The substrate held by the head is pressed against the polishing pad on the polishing table to polish the substrate by relative movement of the substrate and the polishing pad. The substrate polishing apparatus also includes a substrate transfer mechanism for delivering the substrate to be polished to the head and receiving the polished substrate. The substrate transfer mechanism includes a substrate to-be-polished receiver for receiving the substrate to be polished, and a polished substrate receiver for receiving the substrate which has been polished.

23 Claims, 31 Drawing Sheets

SUBSTRATE POLISHING APPARATUS AND METHOD

BACKGROUND OF THE INVENTION

1. Field of the Invention

The present invention relates to a substrate polishing apparatus and method, and more particularly to a substrate polishing apparatus and method suitable for polishing an insulating material layer or a conductive material layer on a large-size glass substrate. Further, the present invention relates to a substrate receiving method.

2. Description of the Related Art

Transparent glass substrates for use in solar cells and flat displays have circuits formed thereon using silver paste by printing. However, the process of using silver paste has been problematic in that such a process is highly costly and experiences difficulty in producing fine interconnections.

As image display apparatuses typified by liquid crystal displays have become larger in size, glass substrates used therein also have become larger in size. For producing fine interconnections for those larger image display apparatuses and reducing the cost of them, there have been demands for an interconnection forming process in which, instead of using carbon paste and silver paste, an insulating layer is deposited on a glass substrate, fine interconnection grooves are formed in the surface of the insulating layer, a plated metal layer (e.g., a plated Cu layer) is embedded in the interconnection grooves, and any extra metal layer is removed to provide a flat surface.

One conventional technology for achieving high surface planarization is the process of polishing wafers (substrates) for fabricating semiconductor devices. Generally, a CMP (Chemical Mechanical Polishing) apparatus is known in the art as an apparatus for polishing wafers. The CMP apparatus comprises a vertical rotatable shaft, a substrate holder mounted on the lower end of the vertical rotatable shaft for holding a substrate with its surface to be polished facing down, another vertical rotatable shaft, a turntable mounted on the upper end of the other vertical rotating shaft facing the substrate holder, and a polishing pad attached to the upper surface of the turntable. In the CMP apparatus, the substrate held by the rotating substrate holder is pressed against the polishing pad on the rotating turntable to polish the substrate. Simultaneously, a polishing liquid such as a slurry, or the like, is used to cause a chemical reaction for polishing the substrate. For details, reference should be made to Japanese laid-open patent publication No. 2003-309089.

If glass substrates to be polished by the CMP apparatus become larger in size, then the CMP apparatus needs to become also larger in size. For making the CMP apparatus higher in functionality and more compact, it is necessary to solve the following problems:

(1) A large-size glass substrate needs to be reliably held against and attracted to the holding surface (flat surface) of the substrate holder. However, a large-size glass substrate is thin and highly liable to be deformed or bent. Furthermore, a glass substrate which is plated with copper or the like before it is polished tends to be warped and is highly likely to break. Such a tendency has to be held to a minimum.

(2) If particles and foreign matter are trapped between the holding surface of the substrate holder and the surface of the glass substrate, then the glass substrate tends to be broken while it is being polished. Therefore, it is necessary to prevent particles and foreign matter from being trapped between the holding surface of the substrate holder and the surface of the glass substrate.

(3) When a large-size glass substrate is polished, the polishing pad on the upper surface of the turntable and the glass substrate have large contact areas, respectively, and produce a large amount of frictional heat. A large amount of heat is also produced by the chemical reaction of the slurry (polishing liquid), or the like. These amounts of heat have to be lowered.

(4) A large amount of slurry (polishing liquid) is required to polish a large-size glass substrate. For reducing the cost of the process of polishing the glass substrate, it is necessary to reduce the amount of the slurry (polishing liquid) which is consumed in the polishing process.

(5) The large-size glass substrate is attracted by the substrate holder through an attracting surface (holding surface) of the substrate holder which has a large attracting area, and is held in close contact with the attracting surface under surface tension. After the glass substrate is polished, therefore, the glass substrate is highly difficult to release (remove) in its entirety from the attracting surface in one direction under uniform forces, and may possibly be damaged when it is removed from the substrate holder. It is necessary to release (remove) the glass substrate from the attracting surface of the substrate holder without causing damage to the glass substrate.

(6) The CMP apparatus requires a large-size cleaning unit for cleaning the large-size glass substrate which has been polished. Generally, the CMP apparatus has a glass substrate transfer unit such as a robot for transferring the glass substrate to the cleaning unit after the glass substrate is polished. However, the glass substrate transfer unit for transferring a large-size glass substrate makes it difficult to make the CMP apparatus more compact and less costly.

(7) The polishing pad attached to the upper surface of the turntable is a consumable product that needs to be replaced after it has reached the end of its service life. However, the polishing pad on the large-size turntable cannot easily be replaced in a short period of time. Therefore, it is necessary to facilitate replacement of the polishing pad for shortening machine downtime.

SUMMARY OF THE INVENTION

It is therefore an object of the present invention to provide a polishing apparatus and method and a substrate receiving method which will solve the above problems (1) through (7), and are capable of polishing large-size glass substrates to higher planarization and cleaning and drying the polished large-size glass substrates.

According to a first aspect of the present invention, there is provided a substrate polishing apparatus comprising: a substrate holding mechanism including a head for holding a substrate to be polished; a polishing mechanism including a polishing table having a polishing tool, the substrate held by the head being pressed against the polishing tool on the polishing table to polish the substrate by relative movement of the substrate and the polishing tool; and a substrate transfer mechanism including a substrate to-be-polished receiver for receiving the substrate to be polished and a polished substrate receiver for receiving the substrate which has been polished, the substrate to-be-polished receiver and the polished substrate receiver being disposed coaxially with each other.

Since the substrate transfer mechanism includes the substrate to-be-polished receiver for receiving the substrate to be polished and the polished substrate receiver for receiving the substrate which has been polished, components of the substrate to-be-polished receiver which support the substrate to be polished and are contaminated by a metal on the substrate do not contact the substrate which has been polished. Therefore, the substrate which has been polished is prevented from being contaminated by such a metal. Because the substrate to-be-polished receiver and the polished substrate receiver are disposed coaxially with each other, they can be placed in a small installation space, so that the substrate polishing apparatus may be reduced in size.

In a preferred aspect of the present invention, the substrate transfer mechanism comprises a cleaning and drying unit for cleaning and drying the polished substrate. Therefore, the polished substrate can be cleaned and dried on the substrate transfer mechanism, and then be delivered to a subsequent process. Even if the substrate is large in size, the substrate can be cleaned and dried without being moved, and hence is not damaged due to flexing, or the like.

In a preferred aspect of the present invention, the substrate to-be-polished receiver includes a first substrate support for supporting a device area of the substrate, and the polished substrate receiver includes a second substrate support for supporting a device-free area of the substrate; and the first substrate support and the second substrate support are actuatable independently of each other. The device area of the polished substrate is not supported and hence is prevented from being damaged.

In a preferred aspect of the present invention, the polished substrate receiver includes a plurality of substrate supports disposed along an outer peripheral edge of the substrate and vertically movably supported by a lifting and lowering mechanism, and a plurality of suction mechanisms mounted respectively on the substrate supports. The polished substrate receiver supports the outer peripheral edge of the substrate, i.e., the device-free area of the substrate. Accordingly, the device area of the polished substrate is prevented from being damaged.

In a preferred aspect of the present invention, the polished substrate receiver includes a tilting mechanism for tilting the substrate. When the substrate is tilted by the tilting mechanism, the substrate which has been attracted to the substrate attracting surface is progressively removed from one end thereof. The substrate can thus be removed from the head with a force smaller than if the substrate is removed at once in its entirety from the head. If the substrate is large in size, it is attracted to the head under large forces. However, the large substrate can be removed with a small force as it is progressively removed from one end thereof.

In a preferred aspect of the present invention, a substrate polishing apparatus further comprises a removing assistor comprising at least one of a string, a rod, and a plate movable parallel to a substrate holding surface of the polished substrate receiver by a moving mechanism.

In a preferred aspect of the present invention, a substrate polishing apparatus further comprises a gas ejection nozzle for ejecting a gas into a gap between the substrate and the head.

After the substrate which has been attracted to the substrate attracting surface is progressively peeled off from one end thereof, the removing assistor is moved parallel to the substrate holding surface of the polished substrate receiver to peel the substrate smoothly off the head. In addition, after the substrate which has been attracted to the substrate attracting surface is progressively peeled off from one end thereof, the gas ejection nozzle ejects a gas into the gap between the substrate and the head for removing the substrate smoothly from the head.

In a preferred aspect of the present invention, the polished substrate receiver includes a sealing mechanism for sealing an outer peripheral portion of the substrate. Since the outer peripheral portion of the polished surface of the substrate is sealed by the sealing mechanism, when a surface of the substrate remote from the polished surface of the substrate is cleaned by a cleaning liquid, the cleaning liquid is prevented from flowing onto the polished surface.

In a preferred aspect of the present invention, the cleaning and drying unit includes a drying mechanism for applying a gas to dry a cleaned area of the substrate.

In a preferred aspect of the present invention, the cleaning and drying unit includes a cleaning liquid removing mechanism for absorbing or removing a cleaning liquid attached to a cleaned area of the substrate.

The mechanism for applying the drying gas or the cleaning liquid removing mechanism makes it possible to dry the cleaned surface of the substrate quickly.

According to a second aspect of the present invention, there is provided a substrate polishing apparatus comprising: a substrate holding mechanism including a head for holding a substrate to be polished; and a polishing mechanism including a polishing table having a polishing tool, the substrate held by the head being pressed against the polishing tool on the polishing table to polish the substrate by relative movement of the substrate and the polishing tool; the head including a substrate holder having a substrate attracting surface for attracting the substrate, and a head body; the substrate holder having an outer circumferential edge vertically movably mounted on the head boy by an elastic member; and the head body including a pressurization and depressurization chamber behind the substrate holder for bringing the substrate, which is to be polished or which has been polished, held by the substrate holder into or out of contact with the polishing tool by changing a pressure in the pressurization and depressurization chamber.

In a preferred aspect of the present invention, the elastic member comprises a diaphragm.

By controlling the pressure in the pressurization and depressurization chamber, the substrate can be brought into contact with the polishing tool, and the force by which the substrate is pressed against the polishing tool can be controlled. After the substrate is polished, the pressurization and depressurization chamber is depressurized to retract the substrate holder into the head body to move the substrate from the polishing tool. As the substrate is moved vertically into and out of contact with the polishing tool only by the substrate holder, the time required to vertically move the head as a whole for moving and polishing a substrate which is large and heavy is short, and the load on the substrate can be controlled by a simple arrangement.

In a preferred aspect of the present invention, the substrate holder is made of an elastic material and the substrate holder has a substrate attracting mechanism.

In a preferred aspect of the present invention, the elastic material has a displacement prevention mechanism and a seal member.

The substrate can be attracted to the substrate attracting surface of the substrate holder, and the substrate holder can move in response to the substrate as the substrate is deformed and the polishing surface of the polishing tool is deformed. The substrate is also prevented from being displaced when it is polished.

In a preferred aspect of the present invention, the displacement prevention mechanism comprises a recess formed in the substrate attracting surface for receiving the substrate therein. Consequently, the substrate is prevented from being displaced by a simple arrangement.

In a preferred aspect of the present invention, the seal member is provided on the substrate attracting surface and positioned along an outer peripheral portion of the substrate.

The seal member seals the gap between the substrate attracting surface and the reverse side of the substrate opposite from the polished surface of the substrate. The substrate attracting pressure (vacuum level) is 20% or more higher than if the seal member is not provided. The substrate can thus be attracted reliably without damage.

The seal member which is mounted on the substrate attracting surface and positioned along the outer peripheral portion of the substrate is effective to prevent particles and foreign matter from entering between the substrate attracting surface and the reverse side of the substrate opposite from the polished surface of the substrate. The substrate is reliably prevented from being broken while it is being polished.

In a preferred aspect of the present invention, the substrate is of a rectangular shape, the elastic member having a constant width from an outer circumferential edge of the substrate holder to the head body, around a circumference of the substrate holder. The elastic member comprising a diaphragm is deformed substantially uniformly fully around the substrate holder, and the rectangular substrate is held in its entirety against the polishing surface of the polishing tool under a substantially constant force, so that the substrate can be polished uniformly.

In a preferred aspect of the present invention, the polishing table includes a plurality of fins for cooling the polishing table.

In a preferred aspect of the present invention, the fins have a function to prevent the polishing table from flexing.

Although the polishing table and the polishing tool are heated by frictional heat generated when the substrate is polished, the heat is dissipated by the fins and the substrate is prevented from being excessively heated. Even if the polishing table has a large diameter, the fins make the polishing table highly rigid radially and prevent the polishing table from flexing.

In a preferred aspect of the present invention, a substrate polishing apparatus further comprises a groove formed in an outer circumferential edge of the polishing table, and a cam follower engaging in the groove. The cam follower engaging in the groove is effective in preventing the polishing table from flexing.

In a preferred aspect of the present invention, a substrate polishing apparatus further comprises a displacement sensor disposed near an outer circumferential edge of the polishing table for detecting a displacement of the polishing table. The displacement sensor monitors a displacement of the polishing table, and thus the displacement of the polishing table can be controlled. The uniformity within the polished surface of the substrate can thus be controlled.

In a preferred aspect of the present invention, a substrate polishing apparatus further comprises a plurality of slurry outlets formed in an upper surface of the polishing table, and a plurality of pressing members for pressing the polishing tool against peripheral edges of the slurry outlets. A slurry discharged from the slurry outlets does not enter between the polishing table and the polishing tool, but is discharged onto the surface of the polishing tool.

In a preferred aspect of the present invention, a substrate polishing apparatus further comprises a plurality of slurry outlets formed in an upper surface of the polishing table, the slurry outlets being positioned in an area of the polishing table which is held in contact with a surface to-be-polished of the substrate while the substrate is being polished. The slurry is thus prevented from squirting upwardly from the slurry outlets, and the consumption of the slurry is reduced.

In a preferred aspect of the present invention, a substrate polishing apparatus further comprises a tube disposed on an outer circumferential portion of the polishing table for pushing an outer circumferential portion of the polishing tool off the polishing table under the pressure of a compressed gas delivered into the tube. Because the outer circumferential portion of the polishing tool is pushed off the polishing table, the slurry is kept within the polishing tool and can be used to polish the substrate. The consumption of the slurry is thus reduced.

In a preferred aspect of the present invention, a substrate polishing apparatus further comprises a gas concentration sensor disposed above the polishing table. The gas concentration sensor is capable of monitoring the concentration of a gas above the polishing table.

In a preferred aspect of the present invention, a substrate polishing apparatus further comprises a dresser tool for dressing a surface of the polishing tool, the dresser tool including a water outlet for discharging water. The water outlet of the dresser tool is effective to discharge dust and debris on the polishing tool, and also to prevent a temperature rise caused by generation of heat when the polishing tool is dressed.

In a preferred aspect of the present invention, the polishing tool comprises a polishing pad mounted on an upper surface of the polishing table, the polishing table including an outlet for discharging at least one of water and a chemical between the polishing table and the polishing pad. Water and/or a chemical discharged from the outlet allows the polishing pad to be easily removed from the polishing table.

In a preferred aspect of the present invention, a substrate polishing apparatus further comprises a gas outlet formed in an upper surface of the polishing tool for discharging a gas. When the polished substrate is removed from the upper surface of the polishing tool, the gas outlet discharges a gas to allow the substrate to be removed from the polishing tool easily without the need for a large force.

In a preferred aspect of the present invention, the polishing tool comprises a plurality of plate-like segments mounted on an upper surface of the polishing table, the plate-like segments being fixed to the upper surface of the polishing table under vacuum suction or by a mechanical fixing member. The plate-like segments of the polishing tool can individually be replaced with new ones with utmost ease.

According to a third aspect of the present invention, there is provided a method of polishing a surface of a substrate by pressing the substrate against a polishing surface of a polishing tool which is larger than the substrate and moving the substrate and the polishing tool relative to each other, comprising: supplying a slurry from a plurality of slurry outlets formed in the polishing surface of the polishing tool; and keeping a surface to-be-polished of the substrate on the polishing surface of the polishing tool so as to cover the slurry outlets while the substrate is being polished.

According to the above method, the slurry is supplied from the slurry outlets in the polishing surface of the polishing tool, and the polished surface of the substrate is positioned on the polishing surface of the polishing tool covering the slurry outlets at all times while the substrate is being polished. Consequently, the slurry is prevented from squiring upwardly from the slurry outlets, and is prevented from being unduly consumed.

According to a fourth aspect of the present invention, there is provided a method of receiving a polished substrate by a substrate receiver having a plurality of substrate supports from a head after the substrate is polished, the substrate being held under vacuum suction on a substrate attracting surface of the head, pressed against a polishing tool mounted on a polishing table and polished by relative movement of the substrate and the polishing tool, comprising: supporting the polished substrate held by the head with the substrate supports which are kept in the same vertical position; lowering the vertical position of selected ones of the substrate supports and releasing vacuum suction of the head to remove the substrate from the substrate attracting surface, thereby tilting the substrate; receiving the tilted substrate by the substrate supports; lowering the vertical position of remaining ones of the substrate supports into alignment with the vertical position of the selected ones of the substrate supports, thereby making the substrate horizontal; and supporting the horizontal substrate by the substrate supports.

According to the above method, after the substrate held by the head is supported by the substrate supports which are kept in the same vertical position, the vertical position of selected ones of the substrate supports is lowered to release the substrate from the substrate attracting surface, thereby tilting the substrate, and the tilted substrate is received. Consequently, the substrate can be removed from the substrate attracting surface of the head more easily than if the substrate is received while the substrate is held horizontally. The substrate is thus prevented from being damaged when it is removed. This method is highly advantageous if the substrate is large in size.

In a preferred aspect of the present invention, the substrate is received by suction cups mounted on respective upper ends of the substrate supports. The substrate can reliably be supported by being held by the suction cups.

The above and other objects, features, and advantages of the present invention will become apparent from the following description when taken in conjunction with the accompanying drawings which illustrate preferred embodiments of the present invention by way of example.

DETAILED DESCRIPTION OF THE INVENTION

Figure 1:
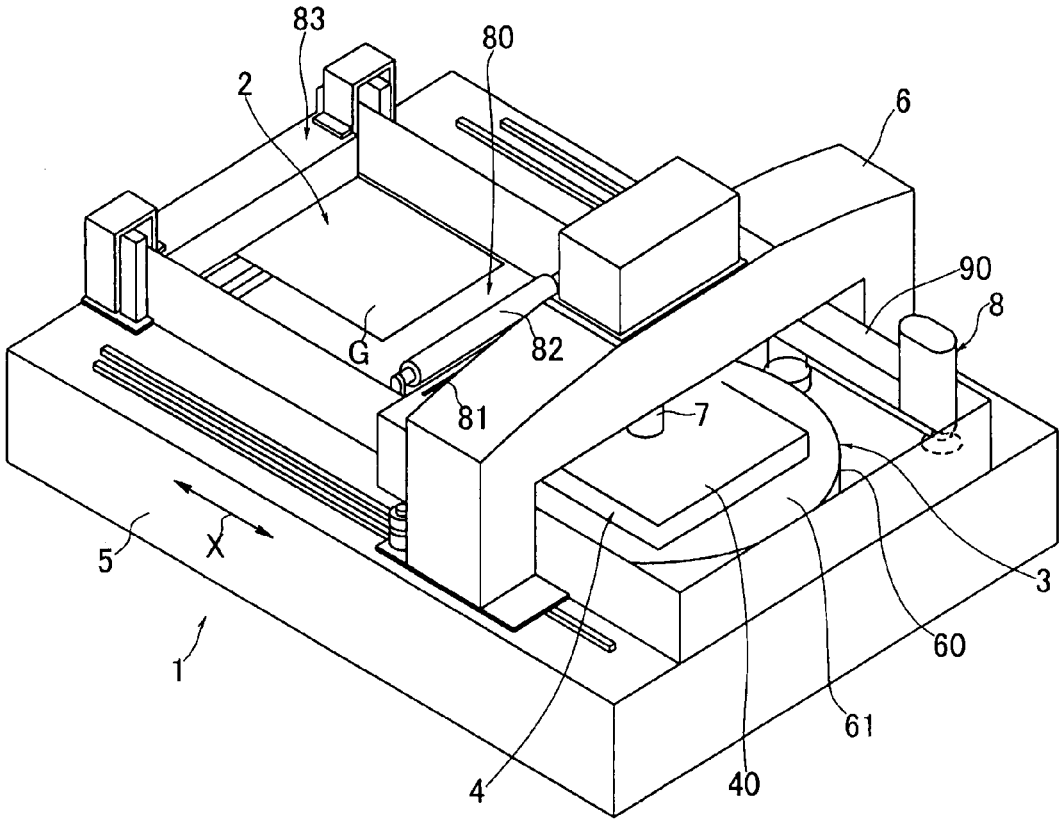
FIG. 1 is a perspective view of a substrate polishing apparatus according to an embodiment of the present invention.

A substrate polishing apparatus according to the present invention will be described in detail below with reference to the drawings. FIG. 1 shows in perspective the substrate polishing apparatus according to the present invention. As shown in FIG. 1, the substrate polishing apparatus, generally denoted by 1, comprises a pusher mechanism 2, a polishing mechanism 3, and a substrate holding mechanism 4. The pusher mechanism 2 transfers a substrate to and from a transfer robot (not shown) and also transfers a substrate to and from the substrate holding mechanism 4. The pusher mechanism 2 constitutes a substrate transfer mechanism. The polishing mechanism 3 polishes a substrate held by the substrate holding mechanism 4. The substrate holding mechanism 4 holds a substrate to be polished and polishes the substrate in cooperation with the polishing mechanism 3. The substrate to be polished comprises a glass substrate, and is simply referred to as a substrate G. The substrate polishing apparatus for polishing the substrate G will be described below. However, the substrate polishing apparatus is not limited to such apparatus used for polishing glass substrates.

As described in detail later, the pusher mechanism 2 comprises a substrate to-be-polished receiver for placing the substrate G to be polished thereon, a polished substrate receiver for placing a polished substrate G thereon, cleaning units 80, 83 for cleaning a polished substrate G, and a drying unit (not shown) for drying a cleaned substrate G. The polishing mechanism 3 comprises a turntable 60, a polishing pad 61 attached to the upper surface of the turntable 60, and a dresser unit 8 for dressing the upper surface of the polishing pad 61 to form a polishing surface suitable for polishing. The substrate holding mechanism 4 has a head 40 for attracting and holding the substrate G. The head 40 is rotatably supported on a portal column 6 by a rotatable shaft 7.

A loading/unloading device such as a transfer robot (not shown) loads a substrate G onto the substrate to-be-polished receiver of the pusher mechanism 2. The substrate G is positioned in place on the substrate to-be-polished receiver by a positioning mechanism, as described later, is pushed upwardly against an attracting surface (holding surface) of the head 40 of the substrate holding mechanism 4 which is positioned directly above the pusher mechanism 2, and is attracted to and held by the attracting surface of the head 40 under vacuum suction. Thereafter, the column 6 moves in a direction indicated by the arrow X to a position directly above the turntable 60 of the polishing mechanism 3. Then, the head 40 is lowered to lower the substrate G and press the substrate G against the polishing surface of the polishing pad 61. At this time, the substrate G is rotated by the head 40, and is polished by relative motion of the substrate G and the polishing pad 61.

After the substrate G is polished, the substrate G is lifted by the head 40, and reaches a position above the pusher mechanism 2 by movement of the column 6 in the direction indicated by the arrow X. The substrate G is lowered by the head 40, and is transferred to and placed on the polished substrate receiver of the pusher mechanism 2. As described in detail later, when the substrate G is moved to the pusher mechanism 2, the polished surface of the substrate G is cleaned. The polished surface of the substrate G is also cleaned when it is placed on the polished substrate receiver of the pusher mechanism 2. Then, the substrate G is dried, and unloaded from the polished substrate receiver by the loading/unloading device.

Structural and operational details of the components of the substrate polishing apparatus 1 will be described below.

Figure 2A:
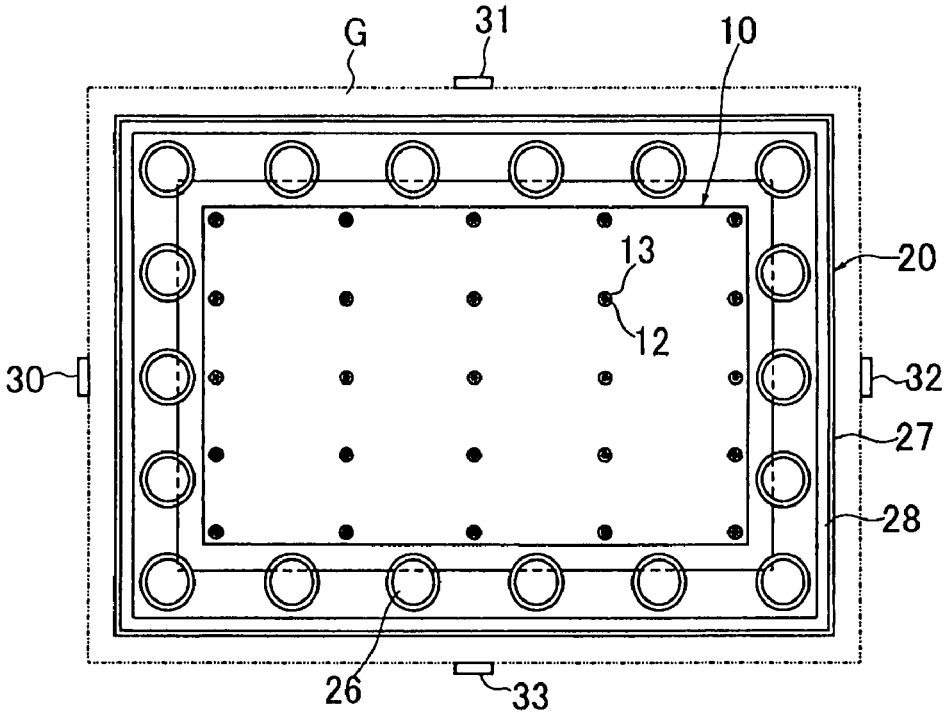
FIG. 2A is a plan view of a pusher mechanism (substrate transfer mechanism) of the substrate polishing apparatus according to an embodiment of the present invention.
Figure 2B:
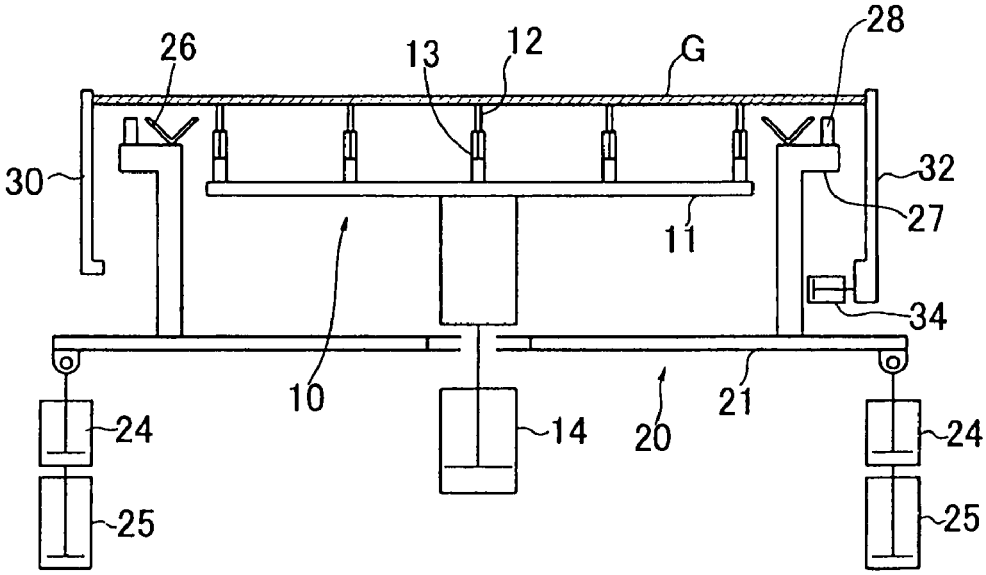
FIG. 2B is a sectional side elevational view of the pusher mechanism.
Figure 3:
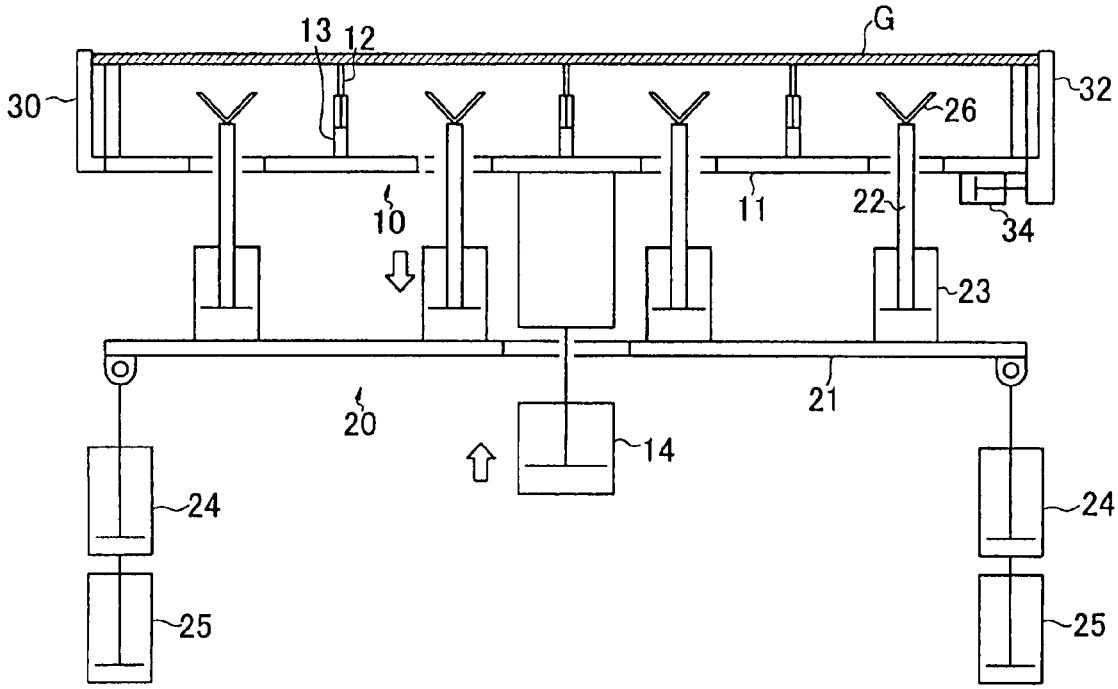
FIG. 3 is a sectional side elevational view showing the manner in which a substrate to-be-polished receiver and a polished substrate receiver of the pusher mechanism operate.

FIGS. 2A, 2B, and 3 show the pusher mechanism 2. FIG. 2A is a plan view of the pusher mechanism 2, FIG. 2B is a sectional side elevational view of the pusher mechanism 2, and FIG. 3 is a sectional side elevational view showing the layout of the substrate to-be-polished receiver and the polished substrate receiver. In the pusher mechanism 2, the substrate to-be-polished receiver 10 for placing the substrate G to-be-polished, and the polished substrate receiver 20 for placing the polished substrate G are disposed coaxially with each other. The substrate to-be-polished receiver 10 includes a base plate 11 supporting thereon a plurality of substrate support pins 12 (25 in the illustrated embodiment) that are vertically movable by respective cylinders 13 mounted on the base plate 11. The base plate 11 is supported on a lifting/lowering cylinder 14, so that the substrate to-be-polished receiver 10 is vertically movable in its entirety by the lifting/lowering cylinder 14.

The polished substrate receiver 20, which is disposed below the substrate to-be-polished receiver 10, includes a base plate 21 supporting thereon a plurality of substrate support members 22 (18 in the illustrated embodiment) that are vertically movable by respective cylinders 23 mounted on the base plate 21. The substrate support members 22 have respective suction cups 26 on the upper ends thereof for supporting outer peripheral edges of the substrate G. The base plate 21 is vertically movably supported by a plurality of lifting/lowering cylinders 24 which are in turn vertically movably supported by respective lifting/lowering cylinders 25. The lifting/lowering cylinders 24 jointly make up a tilting mechanism (described later) for tilting the base plate 21 and supporting the base plate 21. A frame 27, which is rectangular as viewed in plan, is mounted on the upper surface of the base plate 21, and seal members 28 are mounted on the upper end of the frame 27. The suction cups 26 of the polished substrate receiver 20 serve to attract and support a peripheral area (device-free area) of the substrate G which has been polished. The substrate support pins 12 of the substrate to-be-polished receiver 10 are positioned at an area within an array of the suction cups 26 for supporting an inner area (device area) of the substrate G to be polished. In FIG. 2B, the substrate support members 22 and the cylinders 23 are omitted from illustration for the sake of brevity.

The substrate to-be-polished receiver 10 includes a positioning mechanism for positioning the substrate G that has been loaded and placed on the substrate to-be-polished receiver 10. The positioning mechanism comprises a reference member 30 located in one of left and right regions of the substrate to-be-polished receiver 10 (leftward of the substrate G in FIGS. 2A and 2B), another reference member 31 located in one of the front and rear regions of the substrate to-be-polished receiver 10 (behind the substrate G in FIGS. 2A and 2B), and movable members 32, 33 located opposite the reference members 30, 31, respectively. The movable members 32, 33 are pushed by respective cylinders 34 to move the substrate G toward the reference members 30, 31, thereby positioning the substrate G in place on the substrate to-be-polished receiver 10. The cylinder 34 for pushing the movable member 33 is omitted from illustration. The substrate G to be polished can thus always be placed in the same position on the substrate to-be-polished receiver 10 for being attracted under vacuum suction by the head 40 of the substrate holding mechanism 4. Since the substrate G is positioned accurately on the substrate to-be-polished receiver 10, the attracting surface (holding surface) of the head 40 may be of a minimum size required with respect to the substrate G.

The substrate G which has been loaded by the loading/unloading device such as a transfer robot onto the substrate to-be-polished receiver 10 is positioned by the positioning mechanism. The positioned substrate G has its inner area supported by the substrate support pins 12. Since the inner area of the substrate G is supported by the substrate support pins 12, the substrate G is prevented from being flexed or bent by gravity when the substrate G is placed on the substrate to-be-polished receiver 10. Particularly, if the substrate G is large in size, then the heights of the substrate support pins 12 may be adjusted by the respective cylinders 13 to minimize the unwanted flexure of the substrate G.

Figure 4:
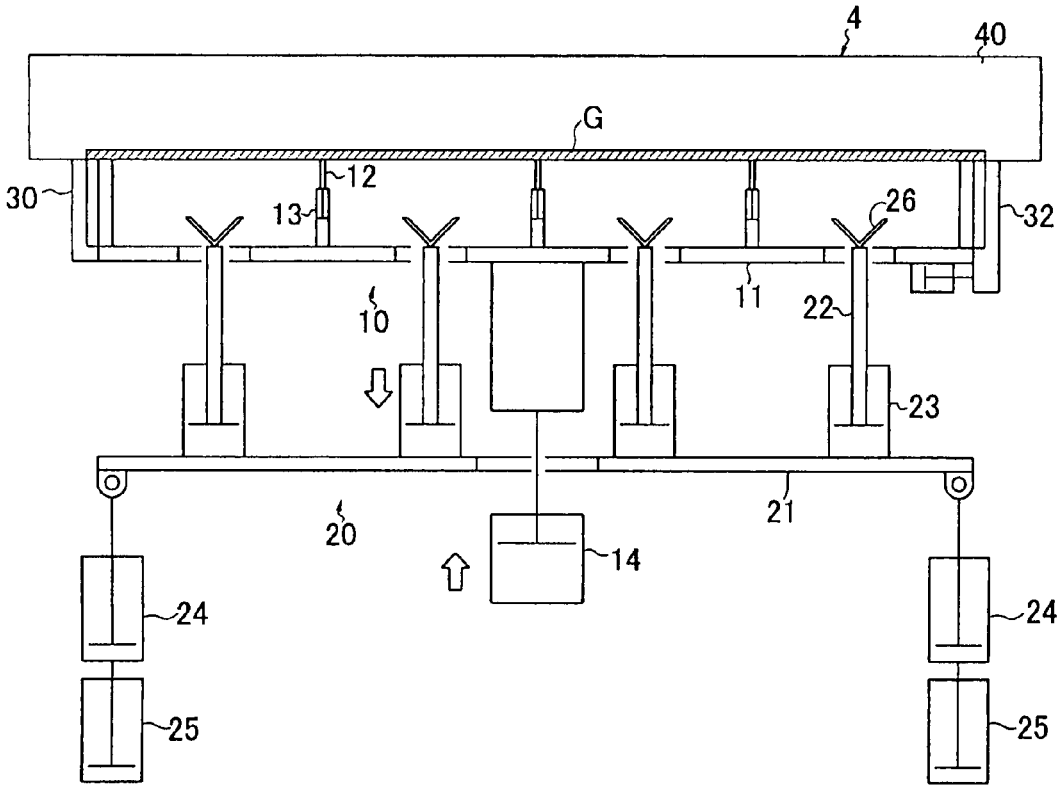
FIG. 4 is a sectional side elevational view showing the manner in which the substrate to-be-polished receiver and the polished substrate receiver of the pusher mechanism operate.

After the flexure of the substrate G is minimized by the substrate support pins 12 whose heights have been adjusted by the cylinders 13, the head 40 of the substrate holding mechanism 4 is positioned above the substrate G, as shown in FIG. 4. The cylinder 14 is actuated to lift the base plate 11 for bringing the substrate G into uniform contact with the attracting surface of the head 40. The substrate G can thus be attracted under vacuum suction by the head 40. The substrate support pins 12 may be replaced with substrate support plates.

Figure 5:
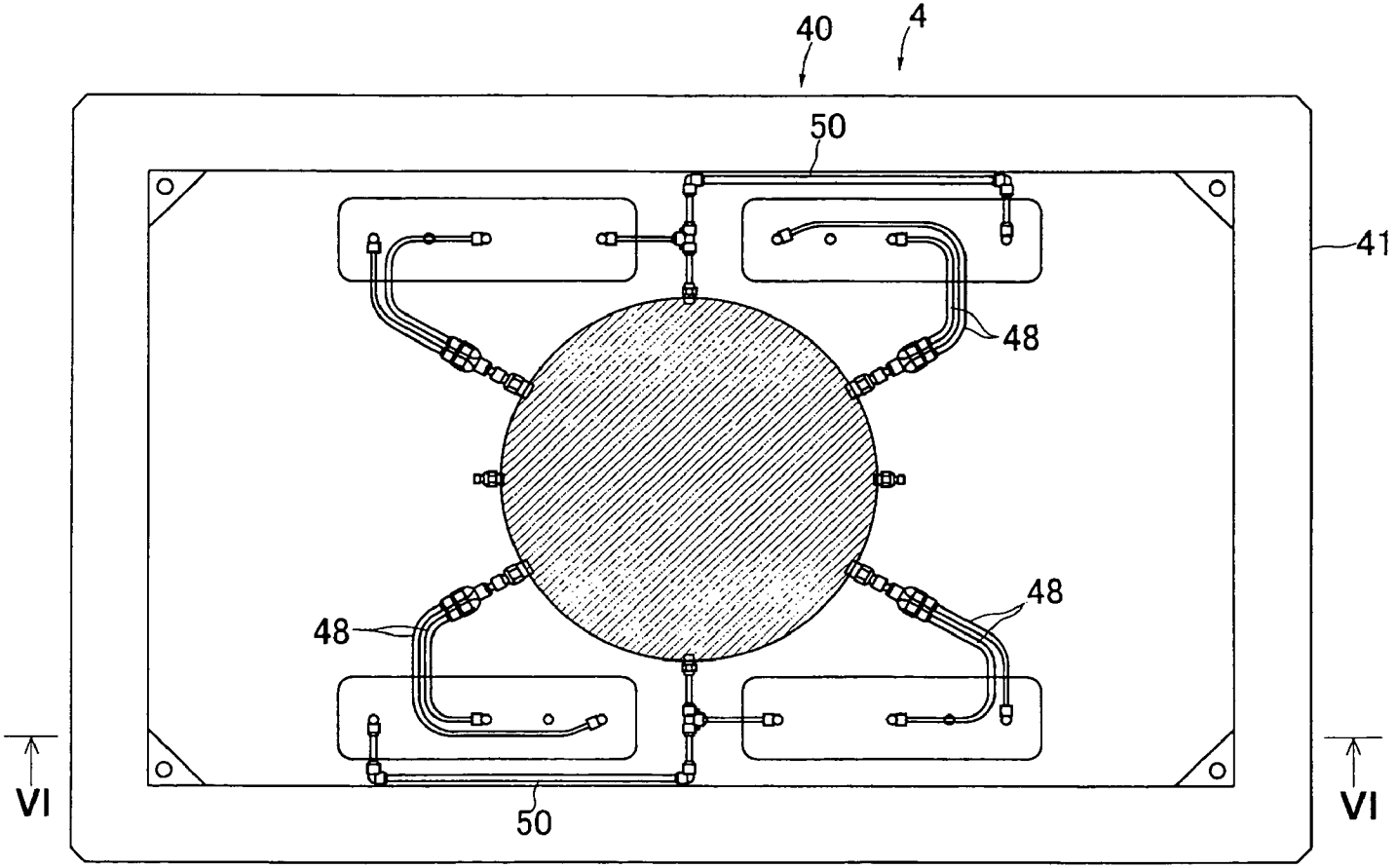
FIG. 5 is a plan view showing a head of a substrate holding mechanism of the substrate polishing apparatus according to an embodiment of the present invention.
Figure 6A:
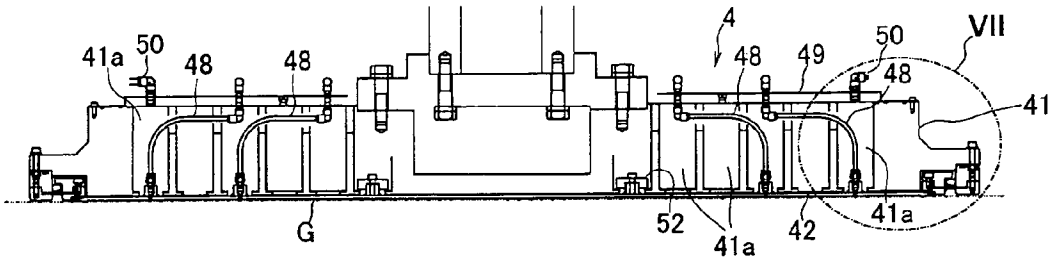
FIG. 6A is a cross-sectional view taken along line VI-VI of FIG. 5.
Figure 6B:
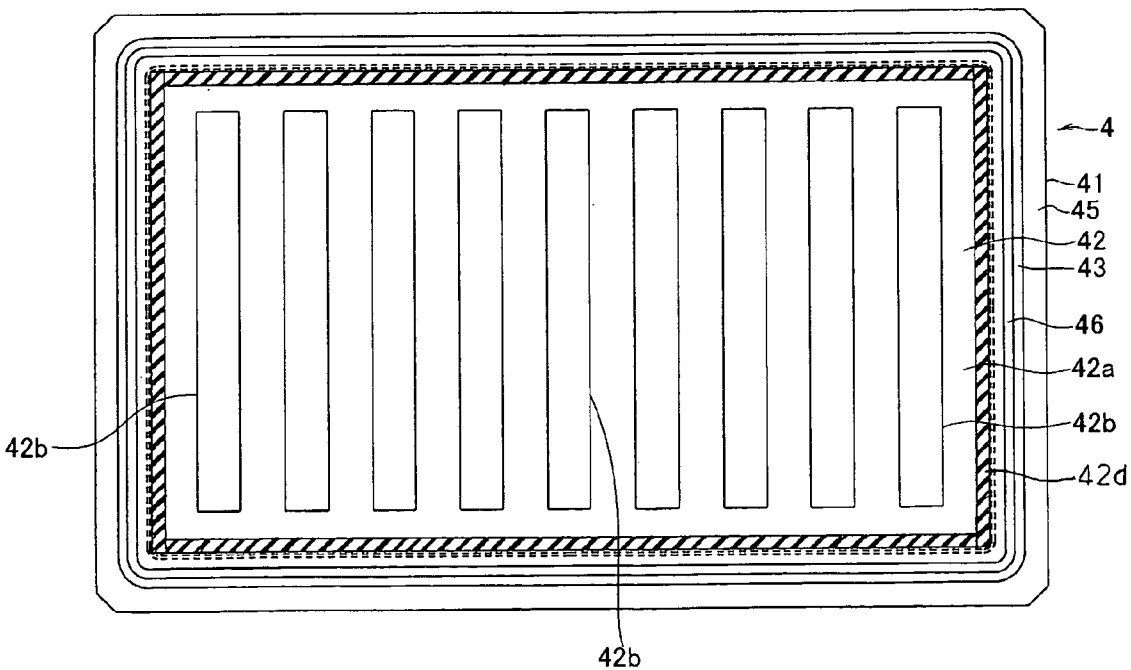
FIG. 6B is a bottom view of the head of the substrate holding mechanism.
Figure 7:
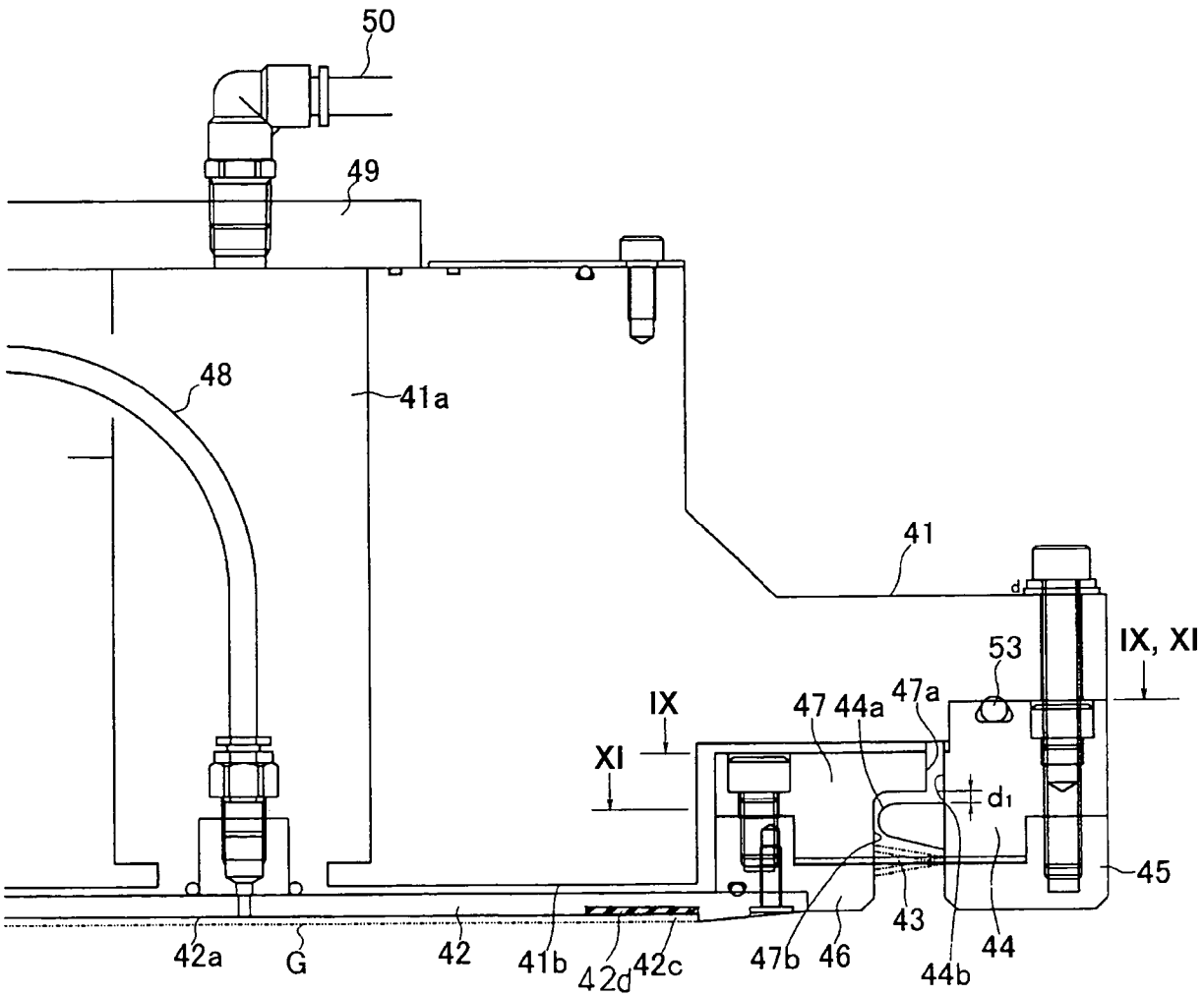
FIG. 7 is an enlarged cross-sectional view of an encircled region VII shown in FIG. 6A.

As shown in FIG. 1, the substrate holding mechanism 4 is mounted on the portal column 6 that is disposed on a frame 5 of the substrate polishing apparatus 1 over the pusher mechanism 2 and the polishing mechanism 3 and is movable in the directions indicated by the arrow X. FIGS. 5 through 7 show the substrate holding mechanism 4 in detail. FIG. 5 is a plan view of the head 40 of the substrate holding mechanism 4. FIG. 6A is a cross-sectional view taken along line VI-VI of FIG. 5, and FIG. 6B is a bottom view of the head 40 of the substrate holding mechanism 4. FIG. 7 is an enlarged cross-sectional view of an encircled region VII shown in FIG. 6A. The substrate holding mechanism 4 includes the head 40 for attracting the substrate G under vacuum suction. The head 40 has a head body 41 which is provided with a substrate holder 42 mounted on a lower surface of the head body 41. The substrate holder 42 has a lower surface 42*a* serving as the attracting surface for attracting the substrate G under vacuum suction.

The substrate holder 42 has an outer circumferential edge portion attached to the head body 41 by a diaphragm 43 serving as an elastic member. Specifically, an outer ring member 44 is fixed to the lower surface of an outer circumferential edge portion of the head body 41 with a seal member 53 such as an O-ring interposed therebetween. The diaphragm 43 has an outer circumferential edge portion clamped to the lower surface of the outer ring member 44 by an outer ring member 45. An inner ring member 46 is fixed to the upper surface of the outer circumferential edge portion of the substrate holder 42. The diaphragm 43 has an inner circumferential edge portion clamped to the upper surface of the inner ring member 46 by an inner ring member 47. Therefore, the substrate holder 42 is vertically movably coupled to the head body 41 by the diaphragm 43.

As shown in FIG. 6B, the width of the diaphragm 43 between the inner circumferential edge of the outer ring member 45 and the outer circumferential edge of the inner ring member 46 is of the same dimension fully around the substrate holder 42. In other words, the substrate holder 42 is connected to the head body 41 by the diaphragm 43 that is of the uniform width throughout its full circumferential length. Accordingly, the substrate holder 42 is uniformly vertically movable around its full circumferential length.

The outer ring member 44 has a ledge 44*a* on its inner circumferential edge, and the ledge 44*a* includes a distal end of an arcuate cross-sectional shape. The inner ring member 47 also has a ledge 47*a* on its outer circumferential edge, and the ledge 47*a* includes a distal end of a rectangular cross-sectional shape. The ledges 44*a*, 47*a* jointly make up a stopper for limiting the downward movement of the substrate holder 42 to a distance d1. As described later, the distal end of the ledge 44*a*, the outer circumferential surface of the base portion of the inner ring member 47, the inner circumferential surface of the base portion of the outer ring member 44, and the distal end of the ledge 47*a* jointly make up a stopper for limiting the torsional movement of the substrate holder 42 and the diaphragm 43. A stopper 52 (see FIG. 6A) for preventing the substrate holder 42 from flexing excessively is disposed on a rear surface of the substrate holder 42.

The substrate holder 42 is made of an elastic material and has such a shape and a thickness which allow the substrate holder 42 to move elastically in response to the deformation of the substrate G and the polishing pad 61 on the turntable 60. Specifically, the substrate holder 42 has a thickness of 5 mm or less if the substrate holder 42 is made of a synthetic resin, or a thickness of 2.5 mm or less if the substrate holder 42 is made of SUS. The substrate holder 42 may be made of a synthetic resin (PP (polypropylen), PPS (polyphenylene sulfide), PEEK (polyether ether ketone), PVC (polyvinyl chloride)), SUS (stainless steel), rubber (EPDM (ethylene-propylene-diene-methylene), FKM (Fluoro Rubber), Si (silicon)), or the like. The substrate holder 42 is made thin and has elasticy so that the substrate holder 42 can move elastically in response to the deformation of the substrate G and the polishing pad 61. The lower surface 42*a* of the substrate holder 42, which serves as the substrate attracting surface, has a plurality of suction grooves 42*b* defined therein over the entire area thereof for attracting the substrate G to the substrate attracting surface 42*a* under vacuum suction, as shown in FIG. 6B. The suction grooves 42*b* communicate with vacuum suction lines 48. The substrate attracting surface 42*a* also has a recess 42*c* defined therein which is complementary in shape to the substrate G for receiving the substrate G therein to prevent the substrate G from being accidentally dislodged from the substrate attracting surface 42*a*.

A seal member 42*d* is made of a highly pliable material such as a backing film (urethane foam), and is disposed on the substrate attracting surface 42*a* of the substrate holder 42 by adhesive bonding, for example. The seal member 42*d* is disposed so as to be positioned along the outer peripheral portion of the attracted substrate G, and should preferably be positioned in a range from 15 mm to 25 mm inwardly from the outer peripheral edge of the attracted substrate G. The seal member 42*d* is placed in a counterbore (cavity) formed in the substrate attracting surface 42*a*, and has a thickness greater than the depth of the counterbore by 0.1 mm to 0.5 mm, thereby providing a protruding portion which can be compressed. The seal member 42*d* may alternatively be made of silicon rubber or EPDM (ethylene-propylene-diene-methylene).

Figure 33A:
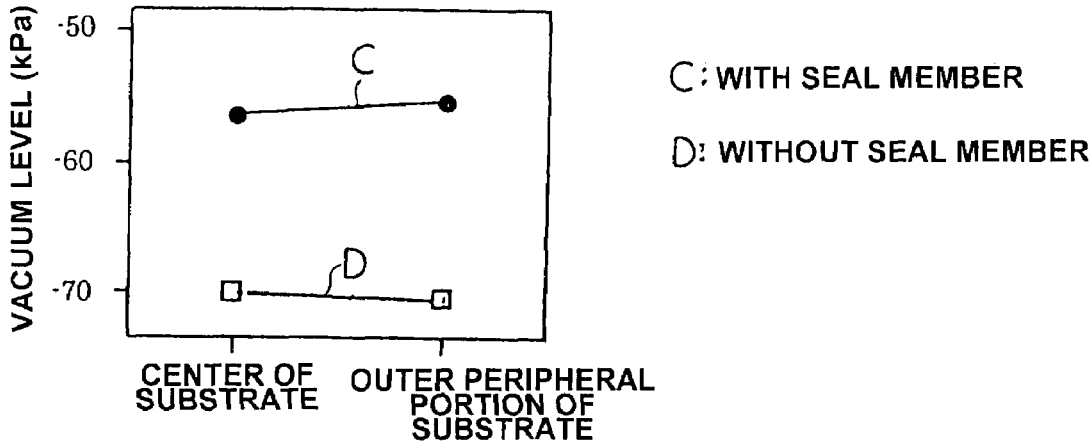
FIGS. 33A and 33B are diagrams showing different vacuum levels achieved when there is a seal member and when there is no seal member in the substrate polishing apparatus according to the embodiment of the present invention.
Figure 33B:
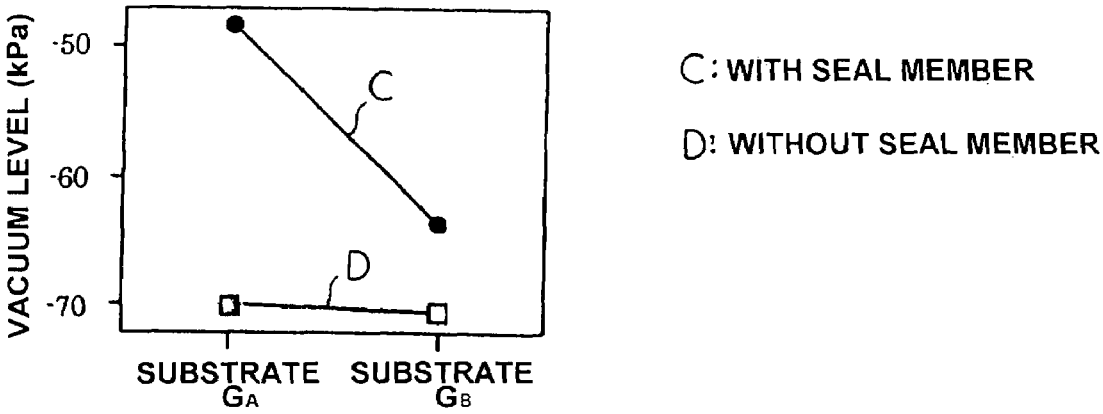

FIGS. 33A and 33B show different vacuum levels achieved when the seal member 42*d* is provided and when the seal member 42*d* is not provided. FIG. 33A shows different vacuum levels (attraction pressures) achieved when the seal member 42*d* is provided and when the seal member 42*d* is not provided in the central portion of the substrate G and in the outer peripheral portion of the substrate G, when the substrate G is attracted. FIG. 33B shows different vacuum levels (attraction pressures) achieved when the seal member 42*d* is provided and when no seal member is provided with respect to different substrates $G_A$, $G_B$. In FIGS. 33A and 33B, the curves C represent vacuum levels achieved when the seal member 42*d* is not provided, and the curves D represent vacuum levels achieved when the seal member 42*d* is provided.

As shown in FIG. 33A, the vacuum levels achieved in the central portion and in the outer peripheral portion of the substrate G are not greatly different from each other regardless of whether the seal member 42*d* is provided or not. It can be confirmed that the vacuum level on the substrate G combined with the seal member 42*d* is 20% or more greater than when the substrate G is not combined with the seal member 42*d*, and the substrate G combined with the seal member 42*d* is reliably attracted and held in position. As shown in FIG. 33B, it is confirmed that the seal member 42*d* is effective to achieve a stable vacuum level (attraction pressure) on the different substrates $G_A$, $G_B$ which can be deformed (flexed) to different degrees.

The inventors of the present invention have confirmed from an experiment conducted on several hundred glass substrates that the seal member 42*d* is effective to prevent particles and foreign matter from entering the gap between the substrate attracting surface 42*a* and the reverse side (unpolished surface) of the substrate G, thereby preventing the substrate G from being chipped (broken) during polishing and from being damaged during transfer of the substrate G. The seal member 42*d* is thus effective to attract various glass substrates G reliably even if the glass substrates G are flexible to different degrees.

Figure 34:
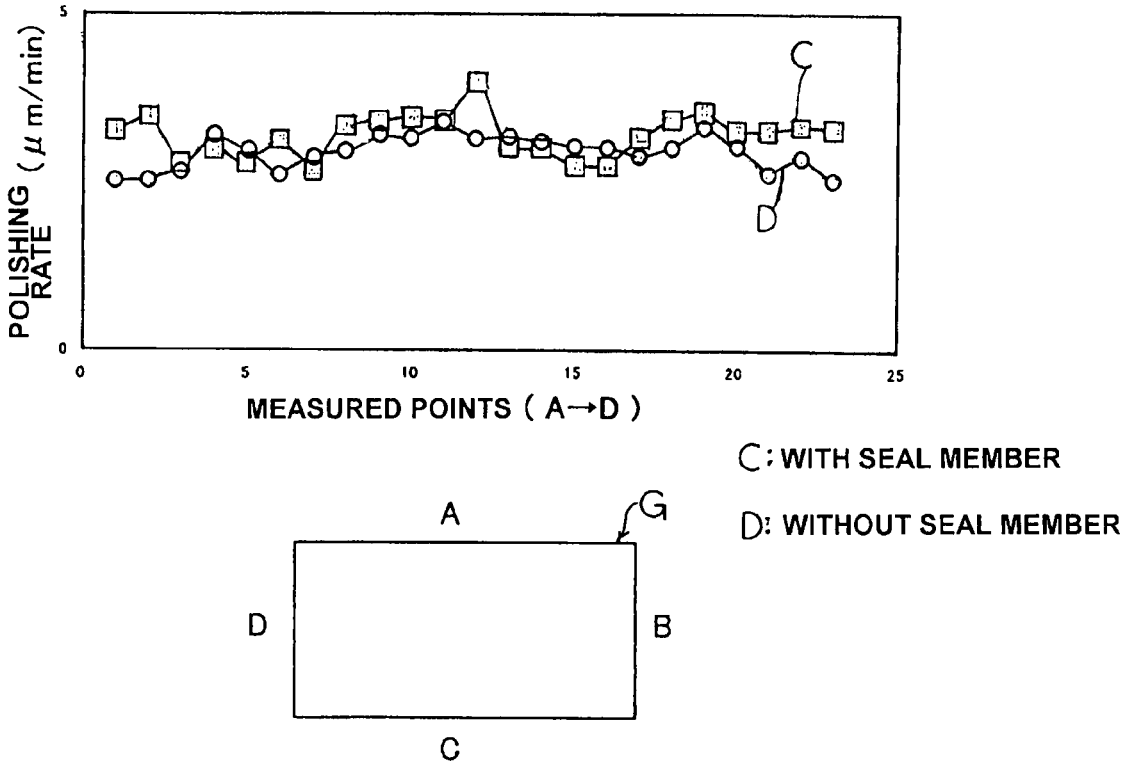
FIG. 34 is a diagram showing different polishing rates on the outer peripheral portion of the substrate which are achieved when there is a seal member and when there is no seal member in the substrate polishing apparatus according to the embodiment of the present invention.

FIG. 34 shows different polishing rates on the outer peripheral portion of the substrate G which are achieved when the seal member 42*d* is provided and when the seal member 42*d* is not provided. FIG. 34 shows the polishing rates measured at outer edges A, B, C, D of the substrate G. In FIG. 34, the curve C represents a polishing rate achieved when the seal member 42*d* is not provided, and the curve D represents a polishing rate achieved when the seal member 42*d* is provided. When the seal member 42*d* is not provided, the polishing rate is in the range from 2.7 μm/min. to 4.0 μm/min., and is thus variable in the range of 1.3 μm/min. When the seal member 42*d* is provided, the polishing rate is in the range from 2.5 μm/min. to 3.4 μm/min., and is thus variable in the range of 0.9 μm/min. It is thus confirmed that the seal member 42*d* is effective to reduce the load that tends to fluctuate, concentrate, and spread on the outer peripheral portion of the substrate G, and to improve (reduce) the range of fluctuations of the polishing rates on the outer peripheral portion of the substrate G by 31%.

The head body 41 has a plurality of chambers 41*a* formed therein behind the substrate holder 42. The chambers 41*a* have respective lower ends which are open behind the substrate holder 42 and respective upper ends closed by a lid 49. The chambers 41*a* are held in communication with fluid pressurization lines 50. The diaphragm 43 is required to have a function to deform itself elastically in response to the movement of the substrate holder 42 and also a function to deform itself elastically in response to the deformation of the substrate holder 42 and the polishing pad 61 when the chambers 41*a* behind the substrate holder 42 are pressurized to press the substrate G held by the substrate holder 42 against the polishing pad 61 and also when the chambers 41*a* are depressurized to retract the substrate G held by the substrate holder 42 into the head body 41. The diaphragm 43 is made of EPDM (ethylene-propylene-diene-methylene), FKM (Fluoro Rubber), Si (silicon), or the like.

When the pressure in the chambers 41*a* in the head body 41 is lowered, the substrate G and the substrate holder 42 are lifted and retracted into the head body 41. When the substrate G and the substrate holder 42 are retracted into the head body 41 by the depressurization in the chambers 41*a*, the substrate G tends to be deformed. In order to prevent the substrate G and the substrate holder 42 from being deformed, the lower surface (bottom surface) of the head body 41 which will be brought into contact with the rear surface of the substrate holder 42 is of a shape and an area which are substantially the same as the substrate G. Pure water or a gas may be ejected from the suction grooves 42*b* formed in the substrate attracting surface 42*a* of the substrate holder 42 to the rear unpolished surface of the substrate G to assist removal of the substrate G from the substrate holder 42.

While the substrate holder 42 is being retracted in the head body 41 by the depressurization in the chambers 41*a*, the substrate to-be-polished receiver 10 is lifted to bring the substrate G into contact with the substrate attracting surface 42*a* of the substrate holder 42, as shown in FIG. 4. The substrate G is now attracted under vacuum suction to the substrate attracting surface 42*a*. The column 6 is moved toward the polishing mechanism 3 in the direction indicated by the arrow X until the head 40 holding the substrate G under vacuum suction is positioned above the turntable 60.

Figure 8:
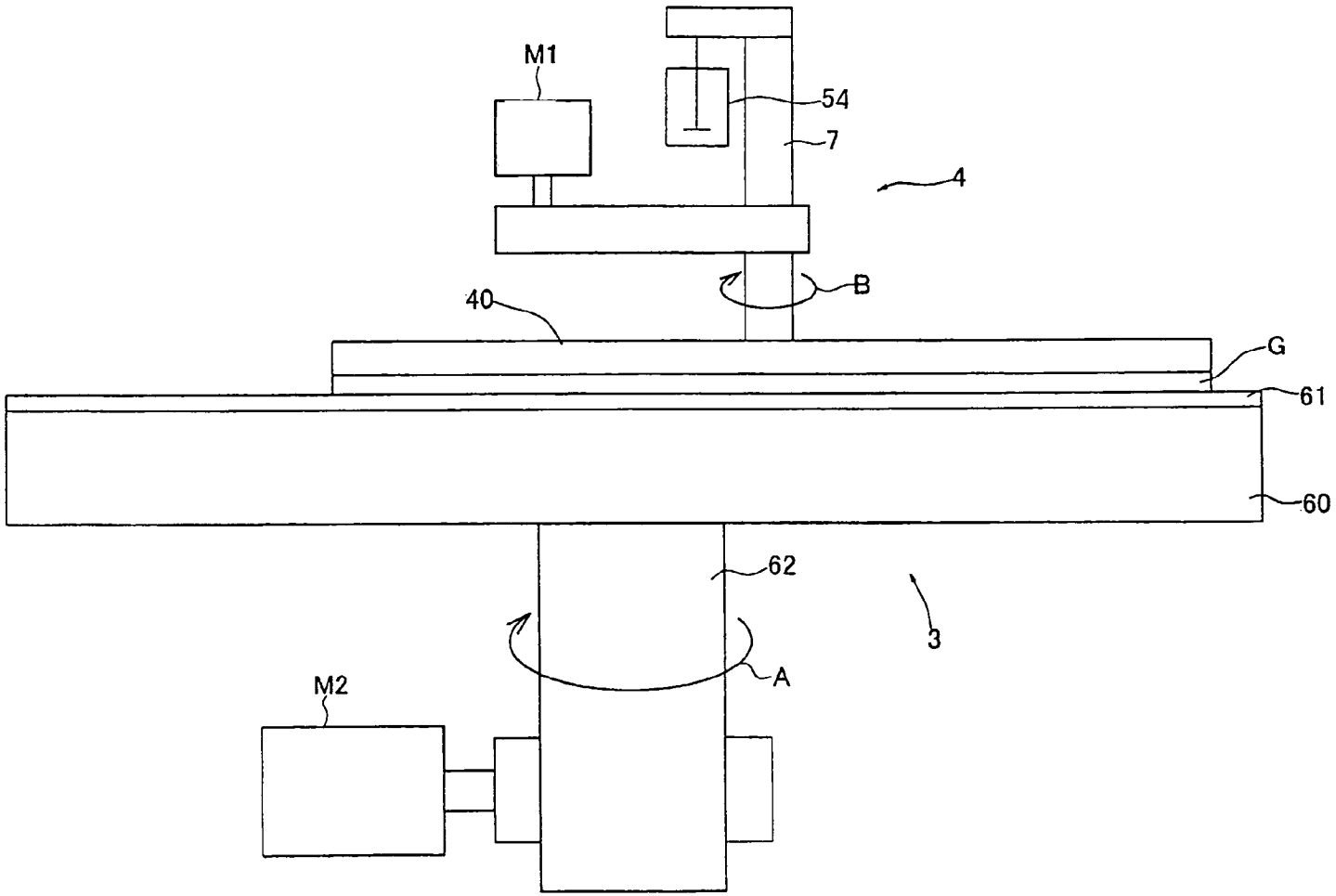
FIG. 8 is a side elevational view of the substrate polishing apparatus according to the embodiment of the present invention.

When the head 40 reaches the position above the turntable 60, the head 40 is lowered to the polishing pad 61 on the turntable 60. During the lowering of the head 40, the substrate holder 42 remains retracted in the head body 41. After the head 40 is lowered to a certain vertical position, the chambers 41*a* are pressurized to release the substrate holder 42 from the head body 41. As shown in FIG. 8, the substrate G held by the head 40 which is rotating is pressed against the upper surface of the polishing pad 61 on the turntable 60 which is also rotating. The substrate G is now polished by the polishing pad 61. The amount of the material removed from the substrate G is adjusted by controlling, i.e., keeping constant or varying, the pressure in the chambers 41*a*. Since both the substrate holder 42 and the diaphragm 43 are elastic, they can move elastically in response to deformation of the substrate G and the substrate holder 42 and local wear of the polishing pad 61. For example, the substrate holder 42 and the diaphragm 43 can move elastically even if the polishing pad 61 contains an anomalous area having a diameter of 300 mm and a depth of 0.3 mm.

When the substrate G is polished, friction heat and reaction heat are generated. In order to suppress these heats, compressed air is normally supplied as a coolant from the pressurization line 50 to the chambers 41*a* to cool the substrate G while the substrate G is being polished. Alternatively, cooling water may be supplied as the coolant to cool the substrate G. The stoppers are provided to prevent the substrate holder 42 and the diaphragm 43 from being loaded because of rotational loads that are applied while the substrate G is being polished. Since lateral loads are imposed on the stoppers, a certain sliding resistance is produced with respect to the vertical polishing pressure applied to the substrate G. Such sliding resistance is likely to adversely affect the polishing profile of the substrate G. In order to allow the stoppers to move vertically, the stoppers are supported by rolling elements such as rollers or incorporate an industrial plated layer having a good coefficient of friction, for example. According to the present embodiment, the substrate G is polished while the substrate G is being attracted under vacuum suction by the substrate attracting surface 42*a* in order to prevent the substrate G from being dislodged from the substrate holder 42 during polishing.

As shown in FIG. 8, the substrate G is polished on the turntable 60 which is rotated in the direction indicated by the arrow A about a shaft 62 by a table rotating mechanism M2 of the polishing mechanism 3. Specifically, the substrate G attracted and held by the head 40 that is rotated in the direction indicated by the arrow B by a head rotating mechanism M1 is pressed against the surface of the polishing pad 61 mounted on the upper surface of the turntable 60. The substrate G is polished by the relative movement of the substrate G and the polishing pad 61. When the substrate G is polished, the surface of the polishing pad 61 is heated by friction with the substrate G. The turntable 60 has a cooling mechanism for lowering the temperature of the heated surface of the polishing pad 61. In FIG. 8, the head 40 is lifted and lowered by a head lifting and lowering mechanism 54.

Figure 9:
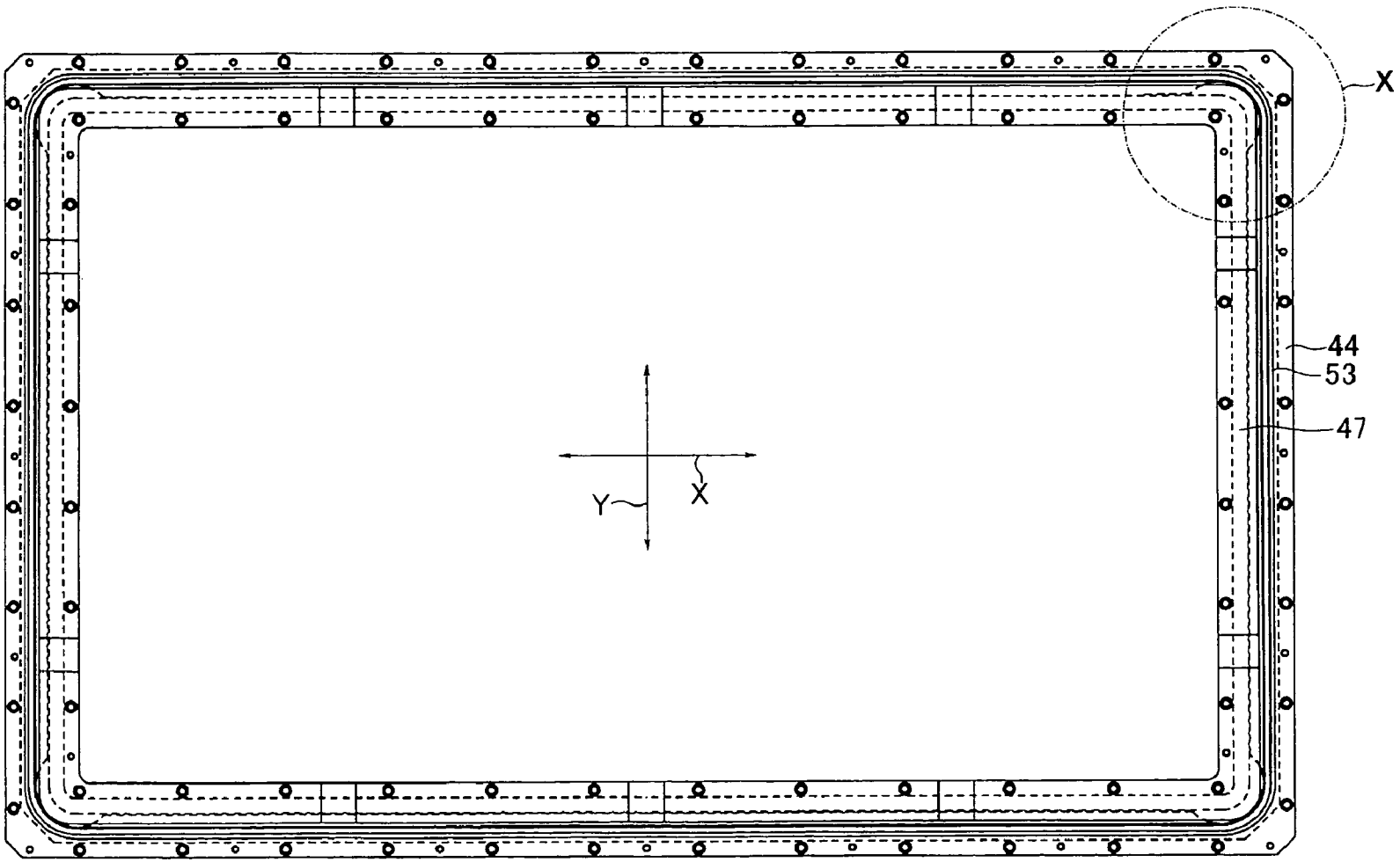
FIG. 9 is a sectional plan view, taken along line IX -IX of FIG. 7, of the head of the substrate holding mechanism.
Figure 10:
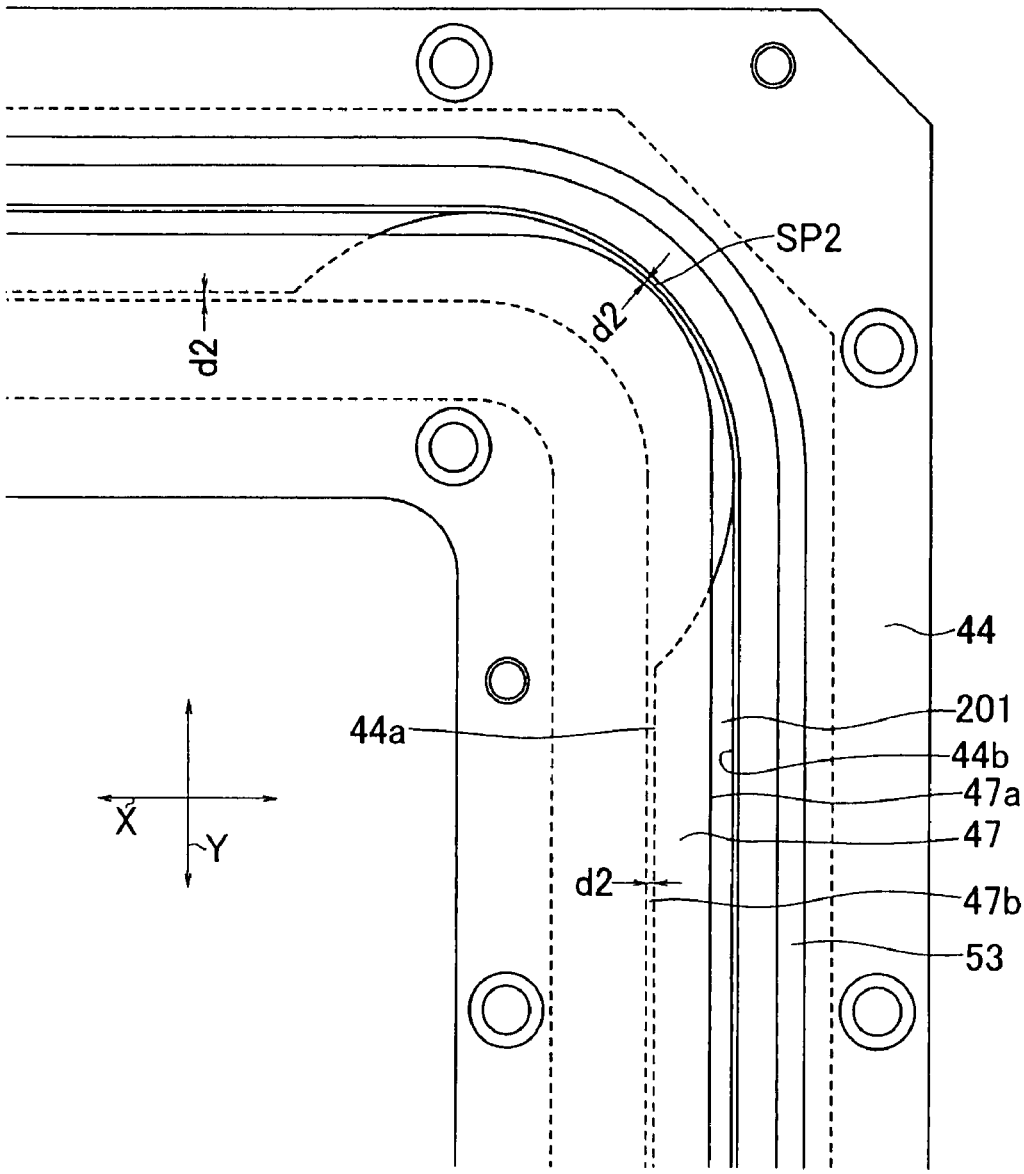
FIG. 10 is an enlarged cross-sectional view of an encircled region X shown in FIG. 9.
Figure 11:
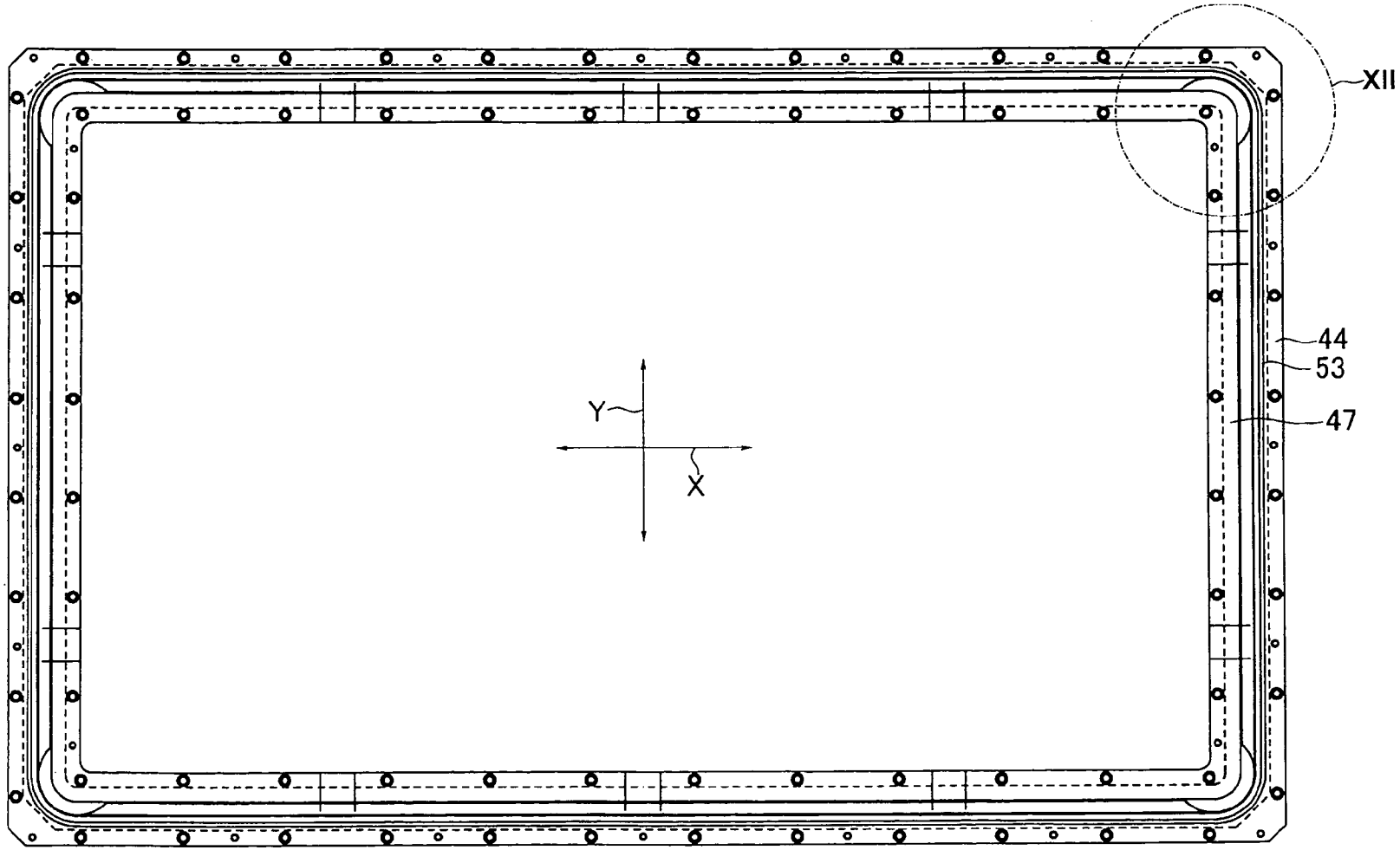
FIG. 11 is a sectional plan view, taken along line XI-XI of FIG. 7, of the head of the substrate holding mechanism.
Figure 12:
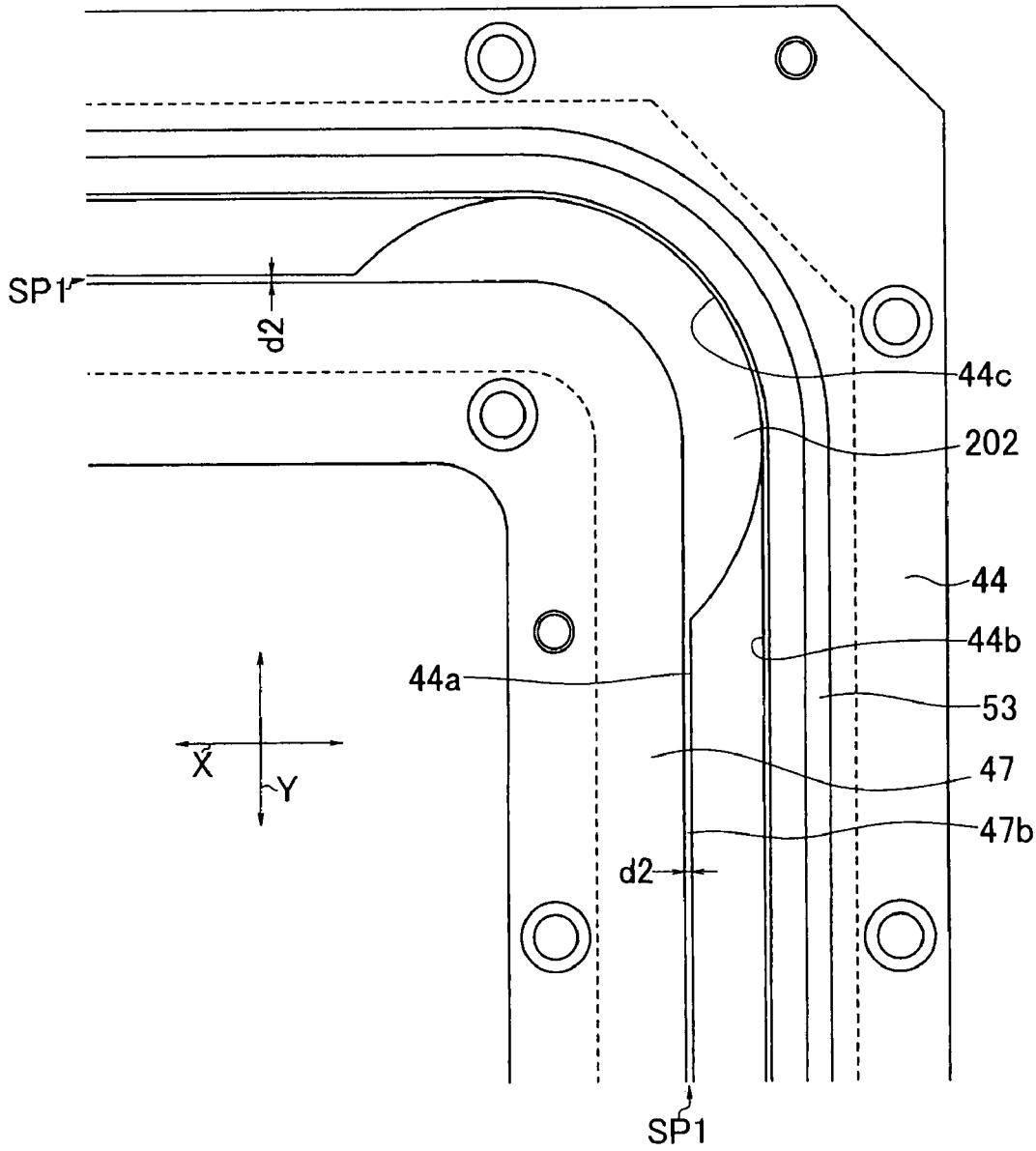
FIG. 12 is an enlarged cross-sectional view of an encircled region XII shown in FIG. 11.

As described above, the stoppers are provided to prevent the substrate holder 42 and the diaphragm 43 from undergoing large loads because of rotational loads that are imposed on the substrate G and the substrate holder 42 while the substrate G is being polished. FIGS. 9 through 12 show structural details of those stoppers. FIG. 9 is a sectional plan view, taken along line IX-IX of FIG. 7, of the outer ring member 44 and the inner ring member 47. FIG. 10 is an enlarged cross-sectional view of an encircled region X shown in FIG. 9. FIG. 11 is a sectional plan view, taken along line XI-XI of FIG. 7, of the outer ring member 44 and the inner ring member 47. FIG. 12 is an enlarged cross-sectional view of an encircled region XII shown in FIG. 11.

As shown in FIG. 12, a stopper SP1 for limiting the movement of the substrate holder 42 in X and Y directions to a distance d2 is formed between the inner circumferential edge of the distal end of the ledge 44*a* of the outer ring member 44 and the outer circumferential surface of a base portion 47*b* of the inner ring member 47. As shown in FIG. 10, a stopper SP2 for limiting the movement of the substrate holder 42 in an intermediate oblique direction between the X direction and the Y direction to the distance d2 is formed between the outer circumferential edge of the distal end of the ledge 47*a* of the inner ring member 47 and the inner circumferential surface of a base portion 44*b* of the outer ring member 44. Therefore, loads that are applied to the substrate holder 42 and the diaphragm 43 of the head 40 to produce their movement in excess of the distance d2 in the X direction, the Y direction, and the intermediate oblique direction (45°) therebetween are borne by the head body 41. The stoppers SP1, SP2 are dimensionally identical to each other.

The stoppers SP1, SP2 are formed as follows: As shown in FIG. 12, a corner on the inner circumferential edge of the ledge 44*a* of the outer ring member 44 is scraped off to form a recess 44*c*, thereby providing a gap 202 between the outer circumferential surface of the base portion 47*b* of the inner ring member 47 and the inner circumferential surface of the base portion 44*b* of the outer ring member 44. Therefore, the stopper SP2 is formed in an upper position between the outer circumferential edge of the distal end of the ledge 47*a* of the inner ring member 47 and the inner circumferential surface of the base portion 44*b* of the outer ring member 44 to limit the movement of the substrate holder 42 in the intermediate oblique direction between the X direction and the Y direction to the distance d2, and the stopper SP1 is formed in a lower position to limit the movement of the substrate holder 42 in the X direction and the Y direction to the distance d2. The reasons for forming the stoppers SP1, SP2 in the above manner are that it is quite hard in terms of a machining process to form a gap of the dimension d2 between the inner circumferential edge of the distal end of the ledge 44*a* of the outer ring member 44 and the outer circumferential surface of the base portion 47*b* of the inner ring member 47 in an entire region ranging from a straight side edge to a curved corner, and hence stoppers at four corners and stoppers at four sides are formed at different vertical positions.

Figure 13:
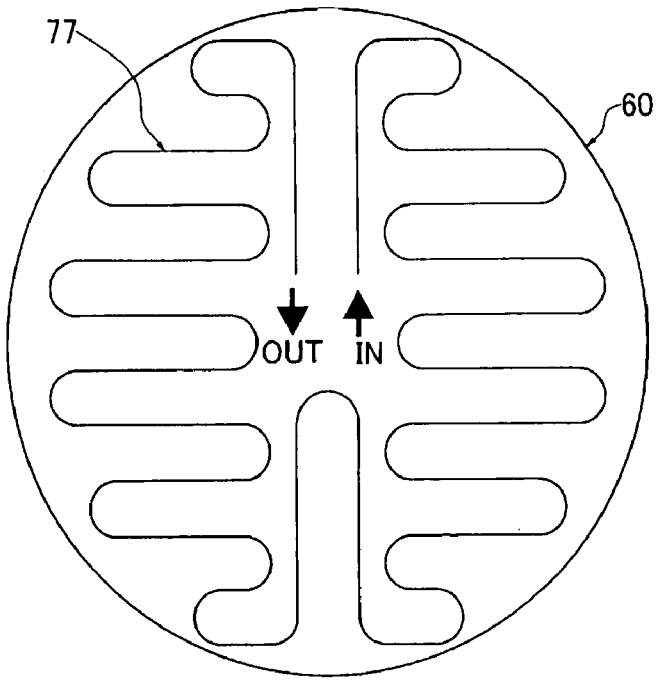
FIG. 13 is a plan view showing a turntable of a polishing mechanism in the substrate polishing apparatus according to an embodiment of the present invention, the view showing a cooling mechanism comprising a coolant passage groove formed in the turntable.
Figure 14:
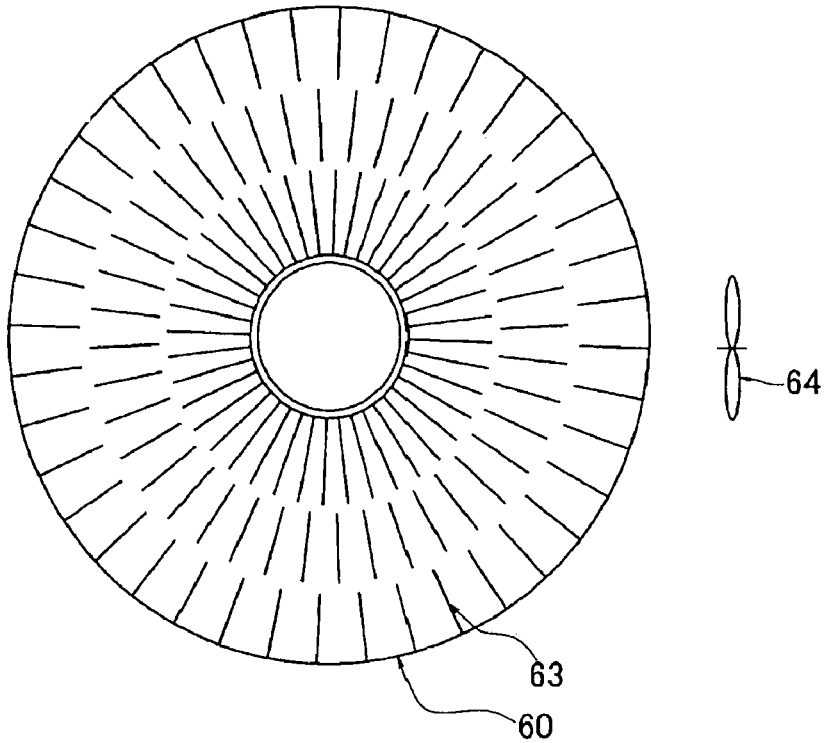
FIG. 14 is a bottom view of another turntable of the polishing mechanism, the view showing another cooling mechanism.

As shown in FIG. 13, the cooling mechanism of the turntable 60 comprises a coolant passage groove 77 formed horizontally in the turntable 60 for passing cooling water or a cooling medium therethrough to cool the turntable 60. Alternatively, as shown in FIG. 14, a turntable 60 may have another cooling mechanism comprising a plurality of radial fins 63 on its reverse side for cooling the turntable 60 with an air flow supplied from a cooling fan 64. The cooling mechanism shown in FIG. 13 and the cooling mechanism shown in FIG. 14 may be combined with each other.

The size of the turntable 60 depends upon the size of the substrate G. For example, if the substrate G has a size of 1000 mm×1000 mm, then the substrate G has a relatively large diameter of rotation having about 1500 mm. In addition, it is the general practice to polish the substrate G while the substrate G and the turntable 60 are rotating about respective axes that are offset from each other. Actually, therefore, the turntable 60 needs to have a diameter which is represented by the sum of the diameter of rotation of the substrate G and twice the radial distance (offset distance) by which the above axes are offset from each other. For example, if the diameter of rotation of the substrate G is 1500 mm and the offset distance is 200 mm, then the turntable 60 needs to have a diameter of 1900 mm. The turntable 60 of this size tends to flex at its outer edge by gravity if the turntable 60 is supported only at its center.

Figure 15:
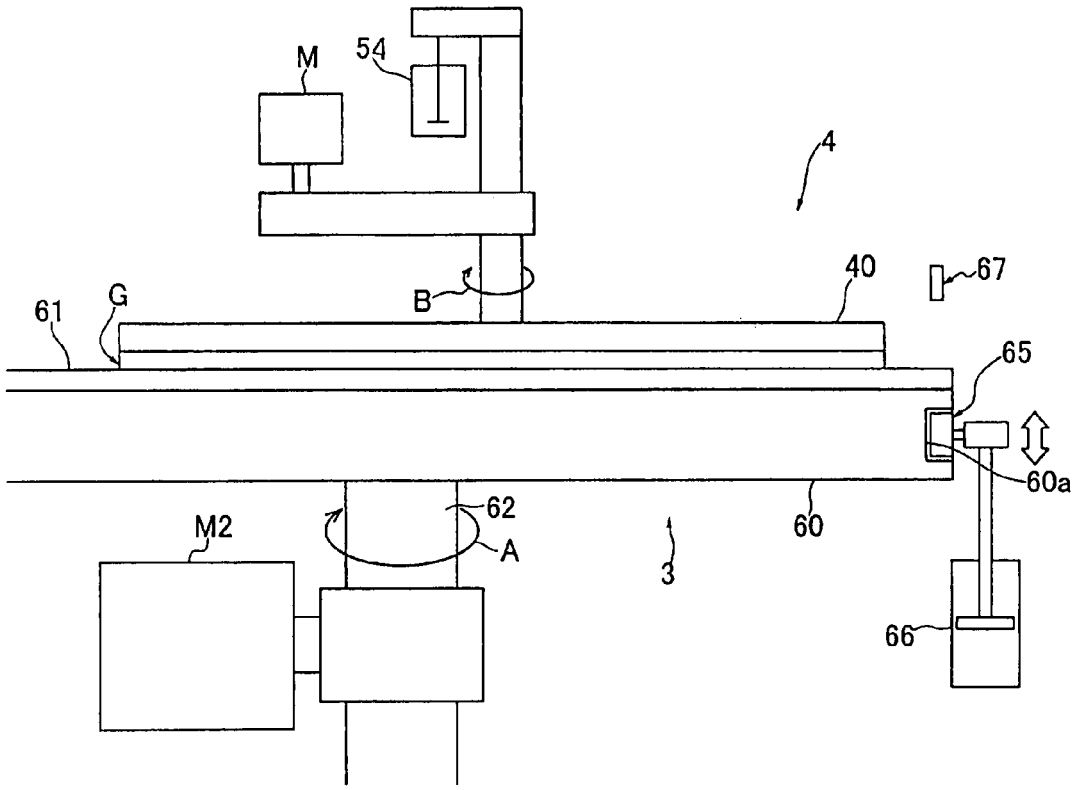
FIG. 15 is a sectional side elevational view of a flexing prevention mechanism of the turntable of the polishing mechanism in the substrate polishing apparatus according to the embodiment of the present invention.

In order to prevent the turntable 60 from flexing at its outer edge, the outer edge may be supported by supporting means. For example, FIG. 15 shows a flexing prevention mechanism of the turntable 60. As shown in FIG. 15, the flexing prevention mechanism includes a cam engaging groove 60*a* formed in the outer circumferential surface of the turntable 60 and at least one cam follower 65 engaging in the cam engaging groove 60*a* for preventing the turntable 60 from being deformed. A displacement sensor 67 is provided above the outer circumferential edge of the turntable 60 for measuring a displacement of the turntable 60 when the head 40 holds and presses the substrate G against the polishing pad 61 on the turntable 60. A cylinder 66 applies a pressure depending on the measured displacement to the turntable 60 through the cam follower 65 engaging in the cam engaging groove 60*a* for thereby controlling the displacement of the turntable 60. In this manner, the planar configuration of the turntable 60 and hence the planar configuration of the polishing pad 61 are controlled. The fins 63 provided radially on the reverse side of the turntable 60 shown in FIG. 14 are effective in increasing the rigidity of the turntable 60 in the radial direction of the turntable 60.

Figure 16A:
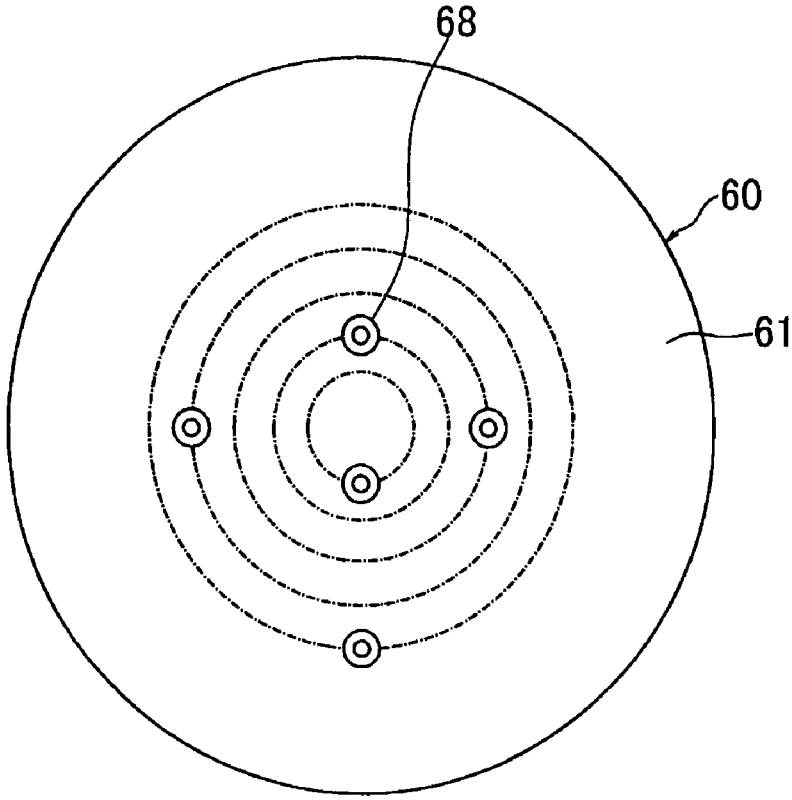
FIG. 16A is a plan view of the turntable of the polishing mechanism in the substrate polishing apparatus according to the embodiment of the present invention.
Figure 16B:
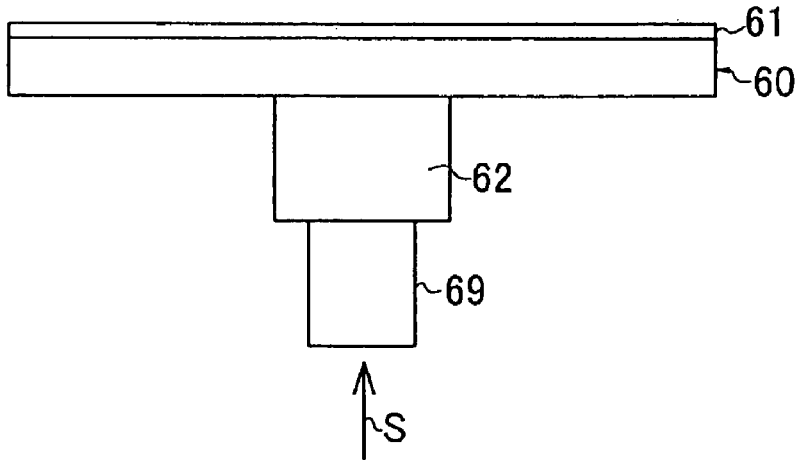
FIG. 16B is a side elevational view of the turntable of the polishing mechanism in the substrate polishing apparatus according to the embodiment of the present invention.

As described above, the substrate G is polished while the substrate G is being held by the rotating head 40 and pressed against the upper surface of the polishing pad 61 on the rotating turntable 60. As shown in FIGS. 16A and 16B, the turntable 60 has a plurality of slurry outlets 68 formed therein on concentric circles around the center of the turntable 60 within a range contacted by the surface of the substrate G which is being polished. The slurry outlets 68 are supplied with a slurry through a rotary supply unit 69 such as a rotary joint and a rotational shaft 62 that are connected to the lower surface of the turntable 60. The supplied slurry is discharged from the slurry outlets 68 and is supplied between the substrate G and the polishing pad 61. Therefore, the slurry is prevented from being squirting upwardly from the slurry outlets 68.

Figure 17:
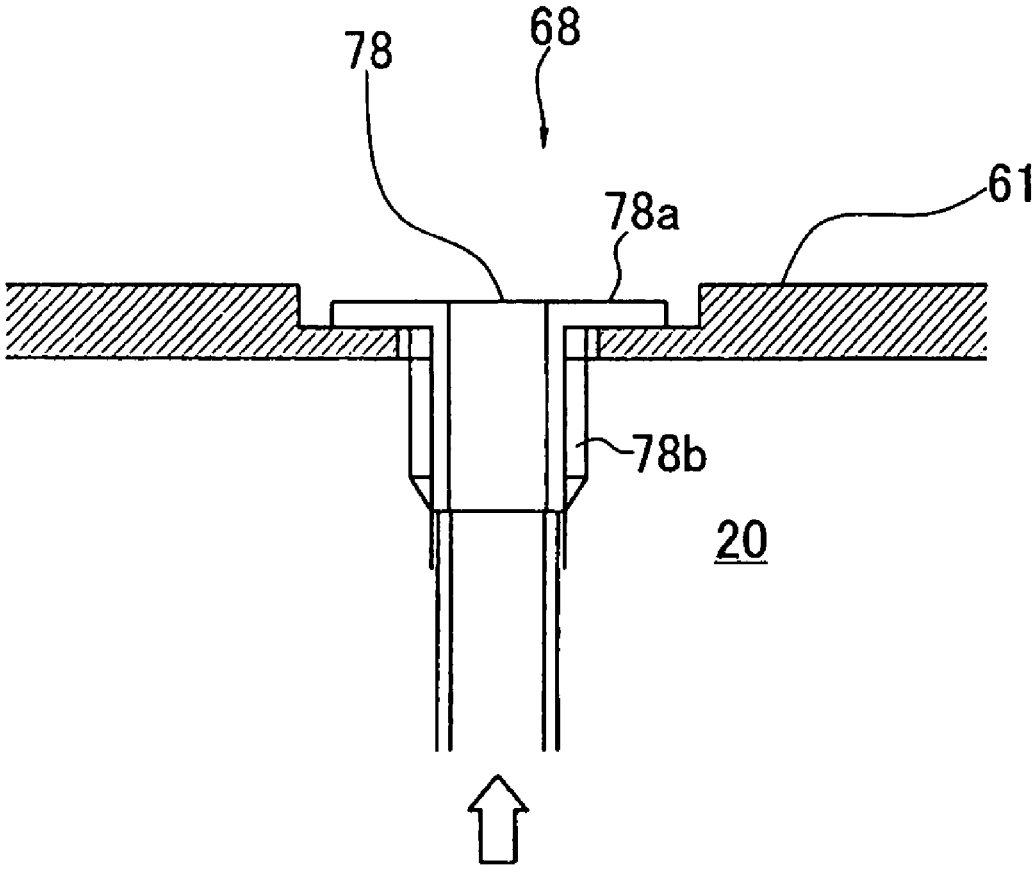
FIG. 17 is a cross-sectional view of a slurry outlet of the polishing mechanism in the substrate polishing apparatus according to the embodiment of the present invention.

When the slurry is discharged from the slurry outlets 68, the slurry enters the gap between the polishing pad 61 and the turntable 60, and thus the polishing pad 61 is liable to be removed from the turntable 61. In order to prevent the polishing pad 61 from being removed from the turntable 61, as shown in FIG. 17, a pressing member 78 is placed in each of the slurry outlets 68 and a corresponding hole in the polishing pad 61 for pressing the polishing pad 61 down on the turntable 60. Specifically, the pressing member 78 is in the form of a hollow tube having a radially outward flange 78*a* on its upper end and an externally threaded outer circumferential surface 78*b* below the flange 78*a*. The pressing member 78 is inserted in the hole in the polishing pad 61 and the slurry outlet 68 in such a manner that the flange 78*a* is placed on the polishing pad 61 and the externally threaded outer circumferential surface 78*b* is held in threaded engagement with an internally threaded inner circumferential surface of the slurry outlet 68. Therefore, the polishing pad 61 is pressed down on the turntable 60 by the flange 78*a* of the pressing member 78.

Since the displacement of the turntable 60 can be controlled by the cam follower 65 engaging in the cam engaging groove 60*a* based on the displacement detected by the displacement sensor 67, the upper surface of the turntable 60 and hence the upper surface of the polishing pad 61 can be controlled in shape for controlling the shape of the polished surface of the substrate G. Specifically, if the upper surface of the turntable 60 and hence the upper surface of the polishing pad 61 are made upwardly convex, then the surface of the substrate G that is polished by the upwardly convex upper surface of the polishing pad 61 is made upwardly concave. Conversely, if the upper surface of the turntable 60 and hence the upper surface of the polishing pad 61 are made downwardly concave, then the surface of the substrate G that is polished by the downwardly concave upper surface of the polishing pad 61 is made downwardly convex. Accordingly, the uniformity of the polished surface of the substrate G can be controlled by controlling the shape of the upper surface of the turntable 60 and hence the upper surface of the polishing pad 61.

Figure 18A:
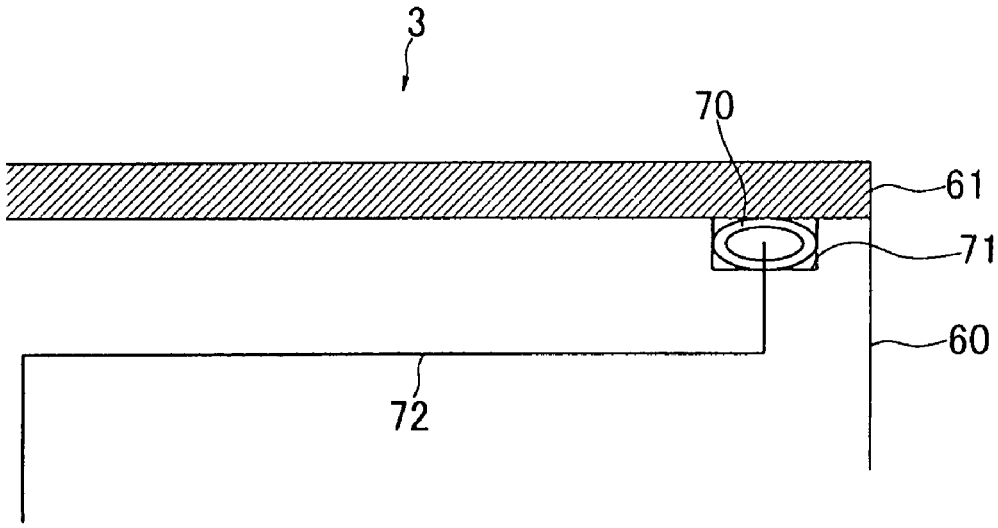
FIGS. 18A and 18B are cross-sectional views of another polishing mechanism in the substrate polishing apparatus according to an embodiment of the present invention, the views showing an end region of the turntable of the polishing mechanism and a polishing pad mounted thereon and also showing the manner in which the turntable and the polishing pad operate.
Figure 18B:
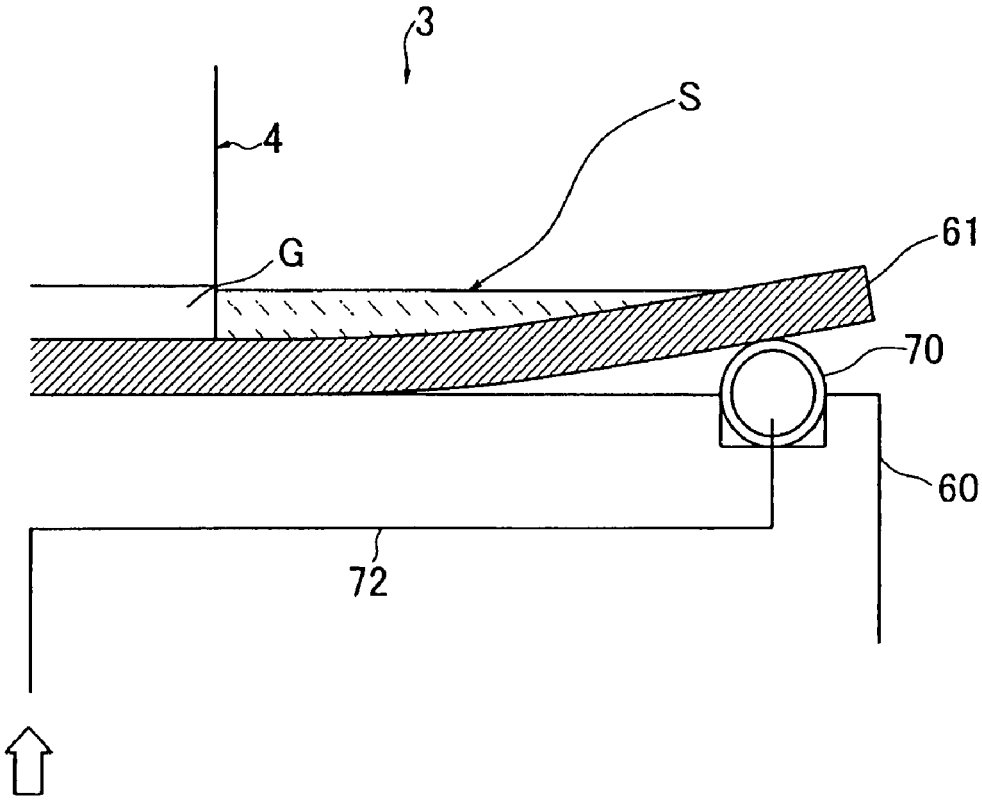

FIGS. 18A and 18B show another polishing mechanism 3 in the substrate polishing apparatus. As shown in FIG. 18A, the polishing table 60 has a tube insertion groove 71 formed in the upper surface of an outer circumferential portion of the polishing table 60. A tube 70 is inserted in the tube insertion groove 71 and the polishing pad 61 is placed on the polishing table 60 over the tube 70. The tube 70 can be supplied with a compressed gas such as compressed air, a nitrogen ($N_2$) gas, or the like through a pipe 72. As shown in FIG. 18B, when the substrate G is polished, the tube 70 is supplied with the compressed gas through the pipe 72. The tube 70 is inflated to lift an outer circumferential portion of the polishing pad 61, thereby keeping the slurry S on the upper surface of the polishing pad 61. The slurry S is thus prevented from flowing out of the polishing pad 61, and hence consumption of the slurry S can be reduced. After the substrate G is polished by the slurry S, the gas in the tube 70 can be discharged to bring the polishing pad 61 into a horizontal position on the turntable 60.

Figure 19:
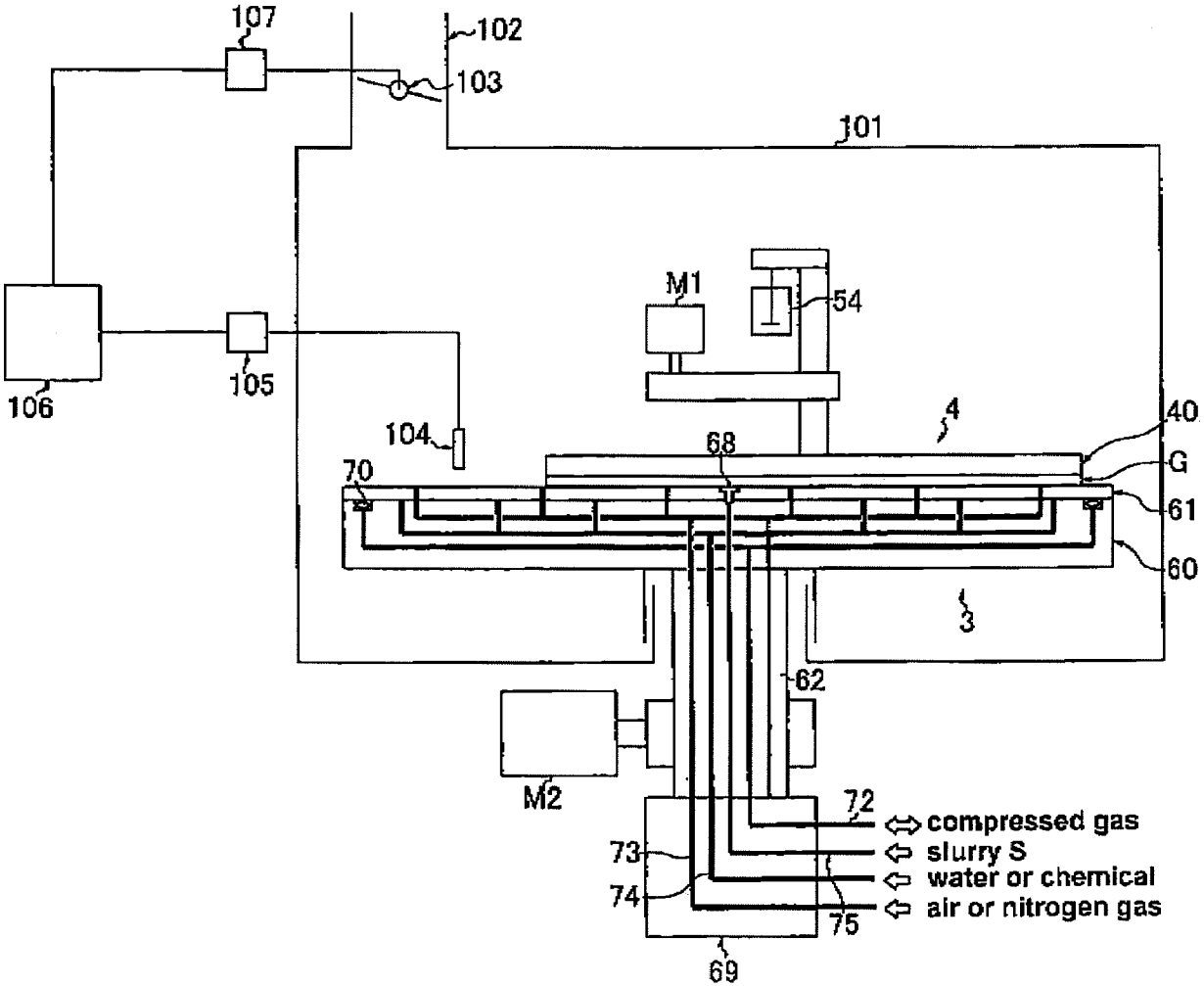
FIG. 19 is a view showing a piping system of the substrate polishing apparatus according to the embodiment of the present invention.

FIG. 19 shows a piping system of the substrate polishing apparatus according to the present invention. As shown in FIG. 19, the polishing mechanism 3 including the substrate holding mechanism 4 is enclosed in a casing 101 that is placed in a room. The casing 101 has an exhaust port 102 in its upper wall. The exhaust port 102 houses therein a rotary actuator 103 combined with a vane for selectively opening and closing the exhaust port 102. As shown in FIG. 19, there are provided a pipe 73 for supplying air or a nitrogen gas, a pipe 74 for supplying water or a chemical, a pipe 75 for supplying a slurry, a pipe 72 for supplying a compressed gas, and other pipes for supplying various gases and liquids. All of these pipes are connected to the turntable 60 through the rotary supply unit 69 and the rotational shaft 62. Although not shown in the drawing, a pipe for supplying cooling water or a coolant to the coolant passage groove 77 in the turntable 60 shown in FIG. 13 may extend through the rotary supply unit 69 and the rotational shaft 62.

Air or a nitrogen gas can be supplied through the pipe 73 onto the upper surface of the polishing pad 61. Water or a chemical can be supplied under high pressure through the pipe 74 to the gap between the turntable 60 and the polishing pad 61. The slurry S can be supplied through the pipe 75 to the slurry outlets 68 which are open on the upper surface of the polishing pad 61. A compressed gas such as compressed air can be supplied through the pipe 72 to the tube 70. A concentration sensor 104 for measuring the concentration of a component that is generated by a chemical used, e.g., a hydrogen concentration sensor, an oxygen concentration sensor, or the like, is disposed above the turntable 60. The number of times that the concentration of the component exceeds an allowable concentration is monitored by a counter 106 through an amplifier 105. If the monitored count exceeds an allowable value, then the counter 106 sends a signal to energize a solenoid-operated valve 107 to operate the rotary actuator 103. Thus, the exhaust port 102 is opened to discharge the air from the casing 101.

Figure 20:
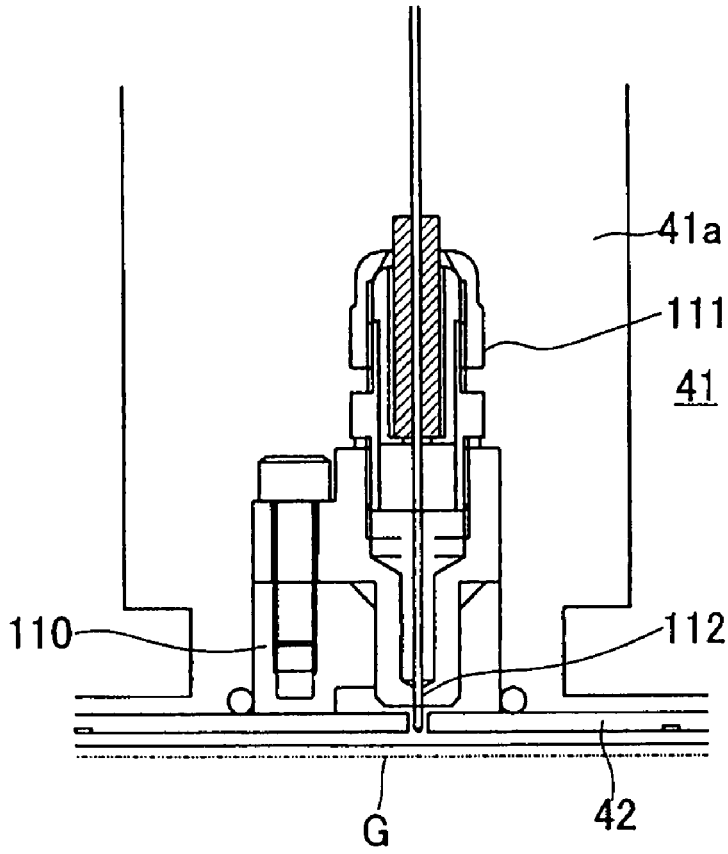
FIG. 20 is a cross-sectional view of a temperature sensor attachment portion of a substrate holder of the head in the substrate polishing apparatus according to the embodiment of the present invention.

As shown in FIG. 20, a temperature sensor 112 is disposed in the substrate holder 42 of the head 40 for measuring the temperature of the substrate G. The flow rate of the cooling water or the coolant supplied to the coolant passage groove 77 in the turntable 60 is controlled depending on a change in the temperature of the substrate G and the substrate holder 42 which has been detected by the temperature sensor 112. The temperature sensor 112 is held by a sensor holder 111 that is mounted on a sensor mount 110 fixed to the reverse side of the substrate holder 42. The temperature sensor 112 thus held by the sensor holder 111 has a tip end inserted in a sensor insertion hole formed in the substrate holder 42. Although not shown in the drawing, a photoelectric sensor or an image sensor may be provided to confirm the removal of a plated metal layer through the substrate G for thereby detecting an end point.

After the substrate G is polished by the slurry, the upper surface of the polishing pad 61 is supplied with water to polish the substrate G with the supplied water. The water is supplied to the entire polished surface of the substrate G from a plurality of water outlets that are formed in the upper surface of the polishing pad 61. After the substrate G is polished with the water, the chambers 41*a* in the head body 41 are depressurized to retract the substrate G and the substrate holder 42 into the head body 41. In order to prevent the substrate holder 42 from being deformed at the time of this retraction, a substrate holder receiver which is of a shape and an area which are substantially the same as the substrate G is provided on the surface of the head body 41 which will be brought into contact with the rear surface of the substrate holder 42, for preventing the substrate holder 42 from being deformed.

After the substrate G is polished with the slurry and the water, the head 40 of the substrate holding mechanism 4 is lifted by the head lifting and lowering mechanism 54 (see FIG. 8). Since the substrate G may not be released from the polishing pad 61, especially when the substrate G is large in size, air or a nitrogen gas is supplied through the pipe 73 (see FIG. 19) and discharged through holes formed in the polishing pad 61 to peel the substrate G easily off the polishing pad 61. The substrate G can easily be removed from the polishing pad 61 if the substrate G overhangs from the turntable 60 to reduce the area of contact between the substrate G and the polishing pad 61 or if the ratio of the rotational speed of the substrate G to the rotational speed of the turntable 60 is changed. If the substrate G to be polished is of an elongated rectangular shape, then rotation of the head 40 is stopped to direct the substrate G in a certain orientation when the head 40 is elevated from the polishing pad 61. The substrate polishing apparatus 1 shown in FIG. 1 stops rotation of the head 40 so as to direct the substrate G in the same orientation as the substrate G is transferred by the pusher mechanism 2. Thus, the substrate G can be easily delivered to the pusher mechanism 2.

Figure 21:
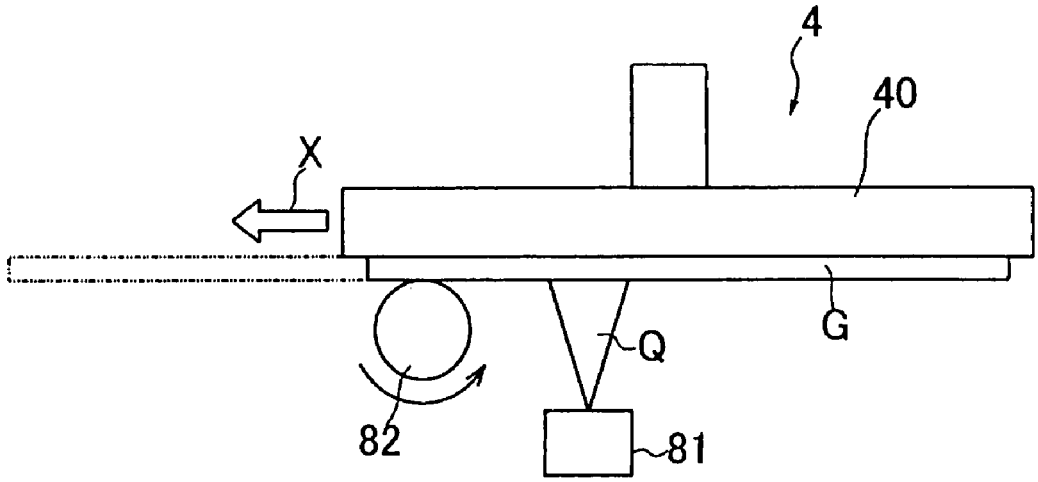
FIG. 21 is a view showing the manner in which the polished surface of the substrate is cleaned after the substrate is polished by the substrate polishing apparatus according to the embodiment of the present invention.

After the substrate G is removed from the polishing pad 61, the column 6 is moved toward the pusher mechanism 2. As shown in FIG. 1, the pusher mechanism 2 includes a first cleaning unit 80 which has a cleaning nozzle 81 and a water absorbing sponge roll 82 for cleaning the polished surface of the substrate G. While the head 40 of the substrate holding mechanism 4 is moving with the column 6 until the head 40 is positioned directly above the polished substrate receiver 20, the cleaning nozzle 81 ejects a cleaning liquid onto the polished surface of the substrate G, and the water absorbing sponge roll 82 absorbs the cleaning liquid applied to the polished surface of the substrate G. FIG. 21 is a view showing the manner in which the polished surface of the substrate G held by the head 40 under vacuum suction is cleaned while the substrate G is moving. When the substrate G held by the head 40 moves in the direction indicated by the arrow X in unison with the column 6, the cleaning liquid Q ejected from the cleaning nozzle 81 of the first cleaning unit 80 cleans the polished surface of the substrate G, and the water absorbing sponge roll 82 absorbs and removes the cleaning liquid applied to the polished surface of the substrate G. The water absorbing sponge roll 82 may be or may not be rotated about a longitudinal axis of the water absorbing sponge roll 82.

Figure 22:
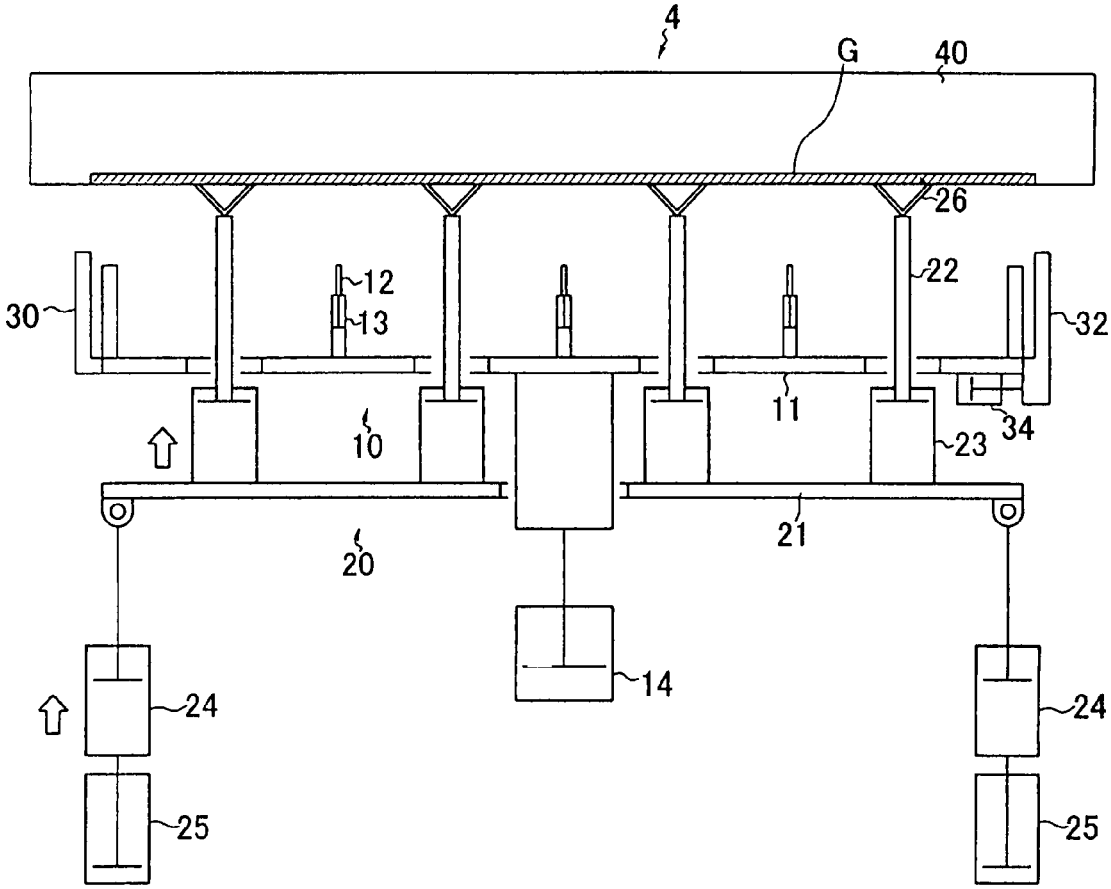
FIG. 22 is a sectional side elevational view showing the manner in which the polished substrate receiver is elevated and suction cups are brought into contact with the substrate that is held by the head.

After the polished surface of the substrate G is cleaned by the first cleaning unit 80 and the applied cleaning liquid is removed therefrom, the substrate G is positioned and stopped directly above the polished substrate receiver 20 of the pusher mechanism. Thereafter, as shown in FIG. 22, the lifting/lowering cylinders 24 of the polished substrate receiver 20 are elevated to elevate the base plate 21 until the suction cups 26 on the upper ends of the substrate support members 22 are brought into contact with the peripheral area of the substrate G which lies around the polished surface of the substrate G. When the suction cups 26 are connected to a vacuum system (not shown), the suction cups 26 hold the peripheral area of the substrate G under vacuum suction. At the same time, vacuum suction of the substrate G is released from the substrate holder 42 of the head 40. The substrate G can thus be removed from the substrate holder 42.

As described above, the polished substrate receiver 20 is coaxial with the substrate to-be-polished receiver 10. The substrate support pins 12 of the substrate to-be-polished receiver 10 support the inner area of the substrate G to suppress flexure of the substrate G. Thus, the substrate G can be reliably held under vacuum suction by the head 40. After the substrate G is polished, however, the substrate G needs to be held in position without causing damage to the device area of the substrate G. Accordingly, the substrate G needs to be held in position in such a state that only the peripheral area (device-free area) of the substrate G is contacted. According to the present embodiment, the different receivers, i.e., the substrate to-be-polished receiver 10 and the polished substrate receiver 20, which are coaxial with each other are used to support the substrate G respectively before and after it is polished. The substrate to-be-polished receiver 10 and the polished substrate receiver 20 separately support the inner and outer areas, respectively, of the substrate G.

Since the substrate support pins 12 of the substrate to-be-polished receiver 10 support the inner area of the substrate G, the device area of the polished substrate G is not contaminated by copper attached to the substrate support pins 12. The polished substrate receiver 20 has the substrate support members 22 having the suction cups 26 and disposed on the base plate 21 for supporting the peripheral area of the substrate G. Because the suction cups 26 on the substrate support members 22 are disposed along the peripheral area of the substrate G, they are effective to prevent the substrate G from flexing.

Figure 23:
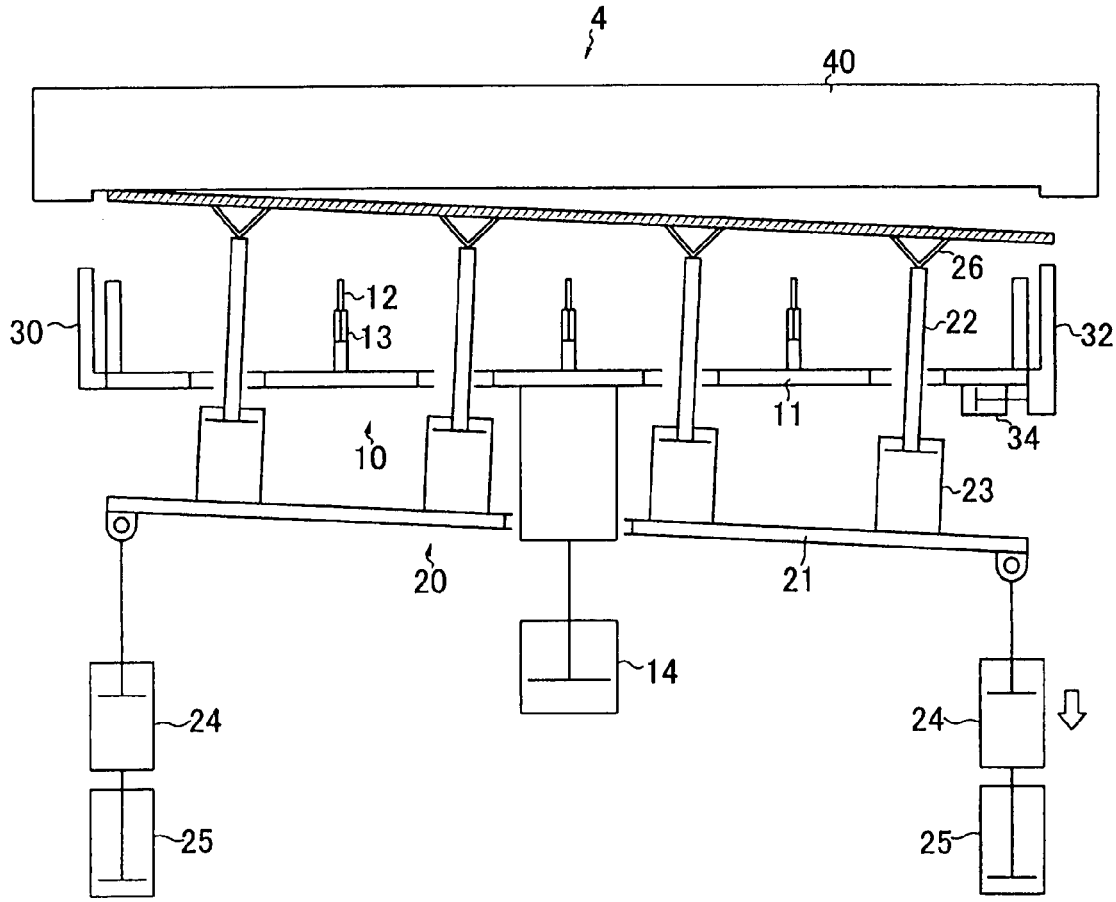
FIG. 23 is a sectional side elevational view showing the manner in which the substrate is released (removed) from the head by a tilting mechanism of the polished substrate receiver in the polishing apparatus according to the embodiment of the present invention.
Figure 24:
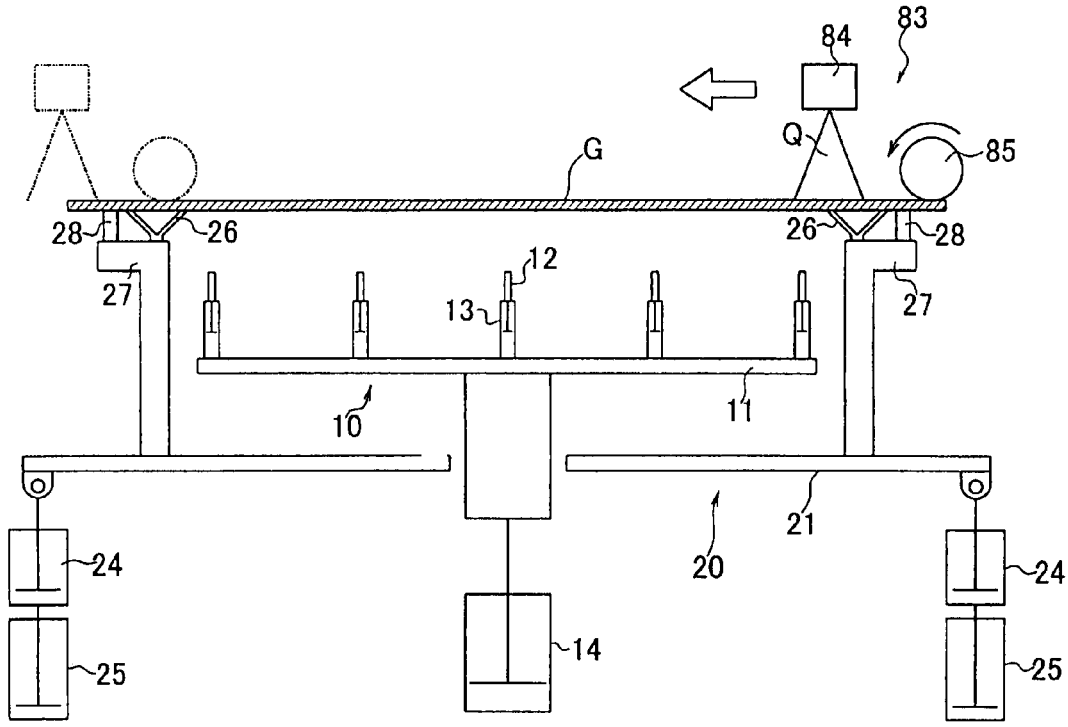
FIG. 24 is a sectional side elevational view showing the manner in which the reverse side of the substrate is cleaned by the pusher mechanism of the substrate polishing apparatus according to the embodiment of the present invention.

The base plate 21 of the polished substrate receiver 20 can be tilted from the position shown in FIG. 22 by a tilting mechanism of the polished substrate receiver 20, as shown in FIG. 23. Specifically, some of the lifting/lowering cylinders 24 on one side are lowered to tilt the base plate 21 of the polished substrate receiver 20. The substrate G is now peeled off from one side of the substrate holder 42 of the head 40. When the substrate G is removed, lifting/lowering cylinders 24 on the other side are lowered. As shown in FIG. 24, the polished surface of the peripheral area of the substrate G is now sealed by closely contact with upper ends of seal members 28. The reverse side (unpolished surface) of the substrate G is then cleaned.

The reverse side of the substrate G is cleaned by a second cleaning unit 83 (see FIG. 1) disposed in the pusher mechanism 2. FIG. 24 shows the manner in which the reverse side of the substrate G is cleaned by the second cleaning unit 83. As with the first cleaning unit 80, the second cleaning unit 83 has a cleaning nozzle 84 and a water absorbing sponge roll 85. The second cleaning unit 83 which is positioned behind the substrate G (see FIG. 1) is elevated to a certain height by a lifting/lowering mechanism (not shown), then moved to the front end of the substrate G by a moving mechanism (not shown), and thereafter lowered by a certain distance. Then, the second cleaning unit 83 cleans the reverse side of the substrate G while the second cleaning unit 83 moves along the reverse side of the substrate G from the front end to the rear end of the substrate G. Specifically, the cleaning nozzle 84 ejects a cleaning liquid onto the reverse side of the substrate G, and the water absorbing sponge roll 85 absorbs the cleaning liquid applied to the reverse side of the substrate G. At this time, since the lower surface of the substrate G is sealed by the seal members 28, the cleaning liquid is prevented from flowing to the polished surface of the substrate G.

Figure 25:
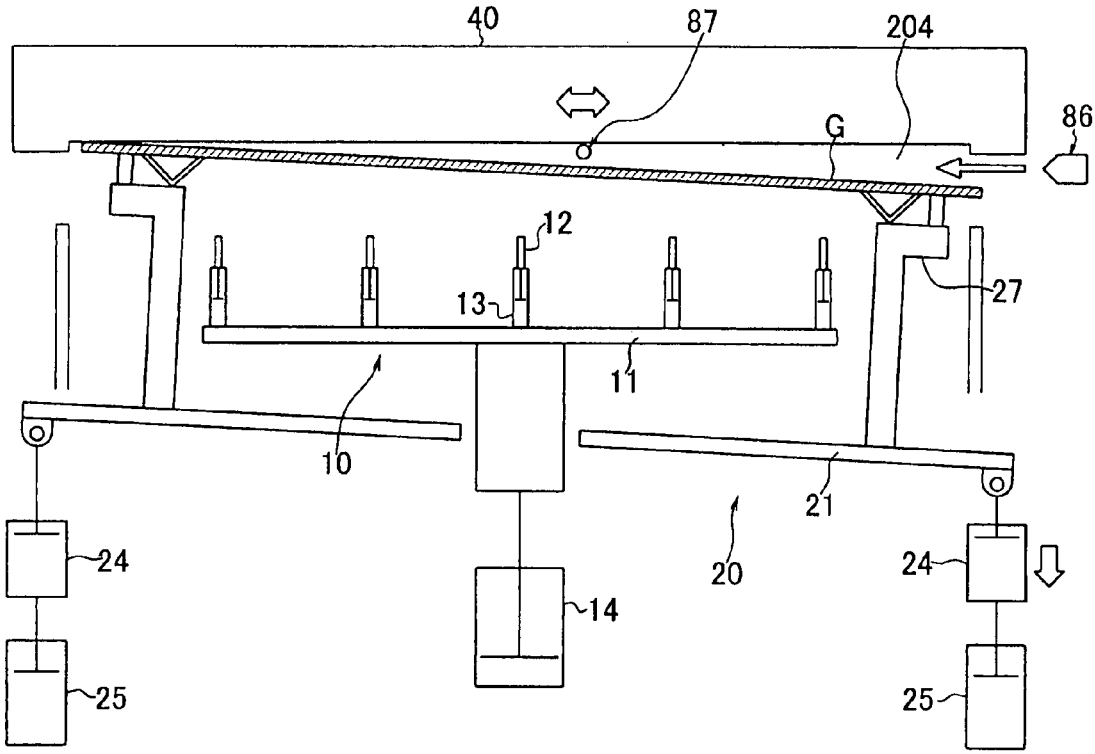
FIG. 25 is a sectional side elevational view showing the manner in which the substrate is released (removed) from the head of the substrate polishing apparatus according to the embodiment of the present invention.

For peeling the substrate G off from the substrate holder 42 of the head 40, the base plate 21 is tilted by the tilting mechanism, as shown in FIG. 25. Specifically, some of the lifting/lowering cylinders 24 on one side are lowered to tilt the base plate 21. When one end portion of the substrate G is removed from the head 40 thereby forming a gap 204 between the end portion of the substrate G and the head 40, air or a gas such as a nitrogen gas or the like is introduced into the gap 204 from a gas ejection nozzle 86. The air or the gas introduced into the gap 204 from the gas ejection nozzle 86 allows the substrate G to be removed smoothly from the substrate holder 42 without causing damage to the substrate G. Alternatively, a removing assistor 87 in the form of a string, a rod, or a plate may be inserted in the gap 204 and moved from a wider end of the gap 204 toward a smaller end thereof, i.e., from the front end to the rear end of the substrate G.

Use of the gas ejection nozzle 86 or the removing assistor 87 allows significant reduction in the probability that the substrate G will be damaged compared to if the substrate G is simply removed from the head 40 from one end thereof. The gas ejection nozzle 86 may be fixed in position or may be moveable from the wider end of the gap 204 toward the smaller end thereof.

Figure 26:
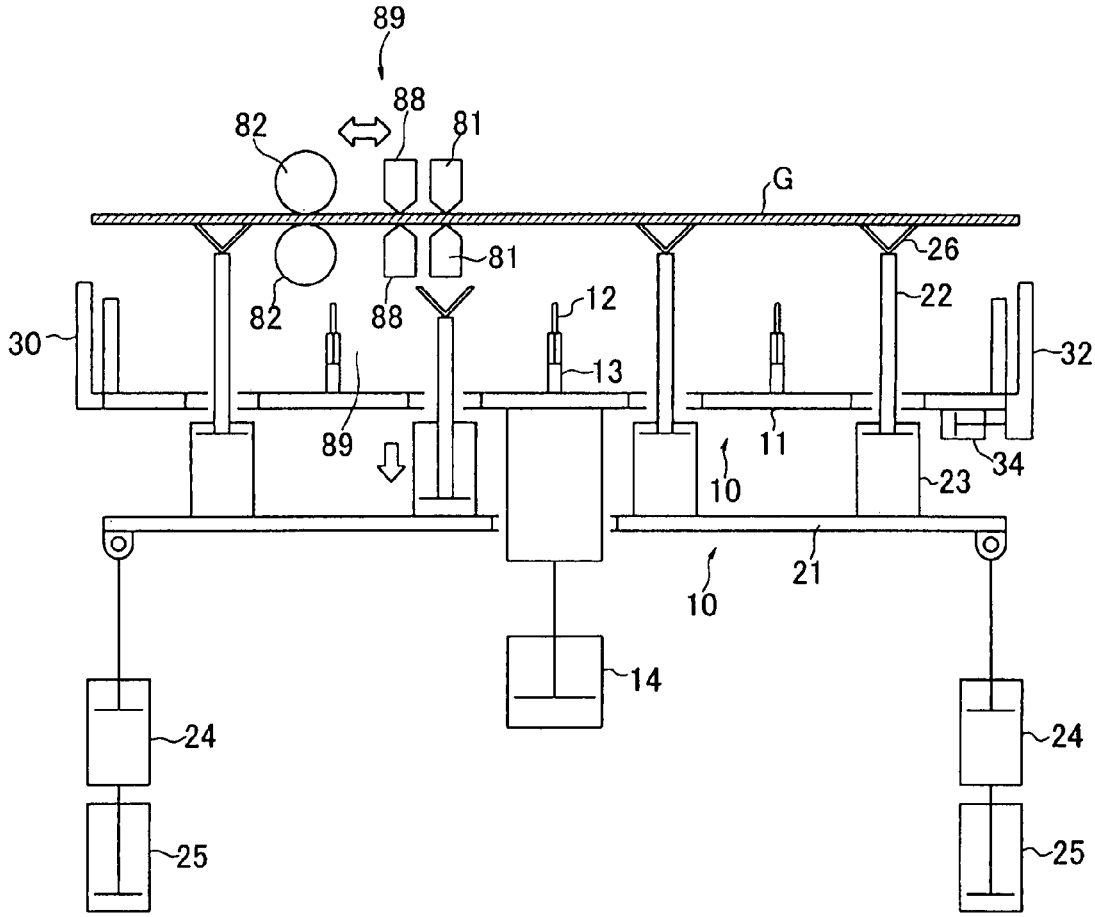
FIG. 26 is a sectional side elevational view showing the manner in which the polished surface and the reverse side of the substrate are cleaned by the substrate polishing apparatus according to the embodiment of the present invention.

Another process of cleaning and drying the substrate G which is being held on the polished substrate receiver 20 after the substrate G is placed on the polished substrate receiver 20 will be described below. As shown in FIG. 26, an upper cleaning and drying unit 89 includes a cleaning nozzle 81, a drying gas nozzle 88, and a water absorbing sponge roll 82 which are disposed above the substrate G placed on the polished substrate receiver 20, and a lower cleaning and drying unit 89 includes a cleaning nozzle 81, a drying gas nozzle 88, and a water absorbing sponge roll 82 which are disposed beneath the substrate G placed on the polished substrate receiver 20. The upper and lower cleaning and drying units 89 clean and dry the substrate G while the upper and lower cleaning and drying units 89 are moving along the substrate from one end to the other thereof. Specifically, the cleaning nozzles 81 eject a cleaning liquid to clean the upper and lower surfaces of the substrate G, and the water absorbing sponge rolls 82 absorb the cleaning liquid applied to the upper and lower surfaces of the substrate G. Thereafter, while the upper and lower cleaning and drying units 89 are moving along the substrate G, the drying gas nozzles 88 eject drying air or a drying gas such as a drying nitrogen gas, or the like, to the upper and lower surfaces of the substrate G to dry the substrate G.

When the lower cleaning and drying unit 89 is moved, the suction cups 26 and the substrate support members 22 present an obstacle to the movement of the lower cleaning and drying unit 89. Therefore, when the lower cleaning and drying unit 89 approaches the suction cups 26 and the substrate support members 22, the cylinders 23 are actuated to lower the suction cups 26 and the substrate support members 22 for allowing the lower cleaning and drying unit 89 to pass therethrough. After the lower cleaning and drying unit 89 has passed, the cylinders 23 are actuated again to bring the suction cups 26 successively into contact with the lower surface of the substrate G and to support the substrate G. If the cleaning nozzles 81, the drying gas nozzles 88, and the water absorbing sponge rolls 82 are longer than the width of the substrate G, then the substrate G can be cleaned when the cleaning nozzles 81 and the water absorbing sponge rolls 82 move in one stroke and can be dried when the drying gas nozzles 88 move in one stroke.

Figure 27:
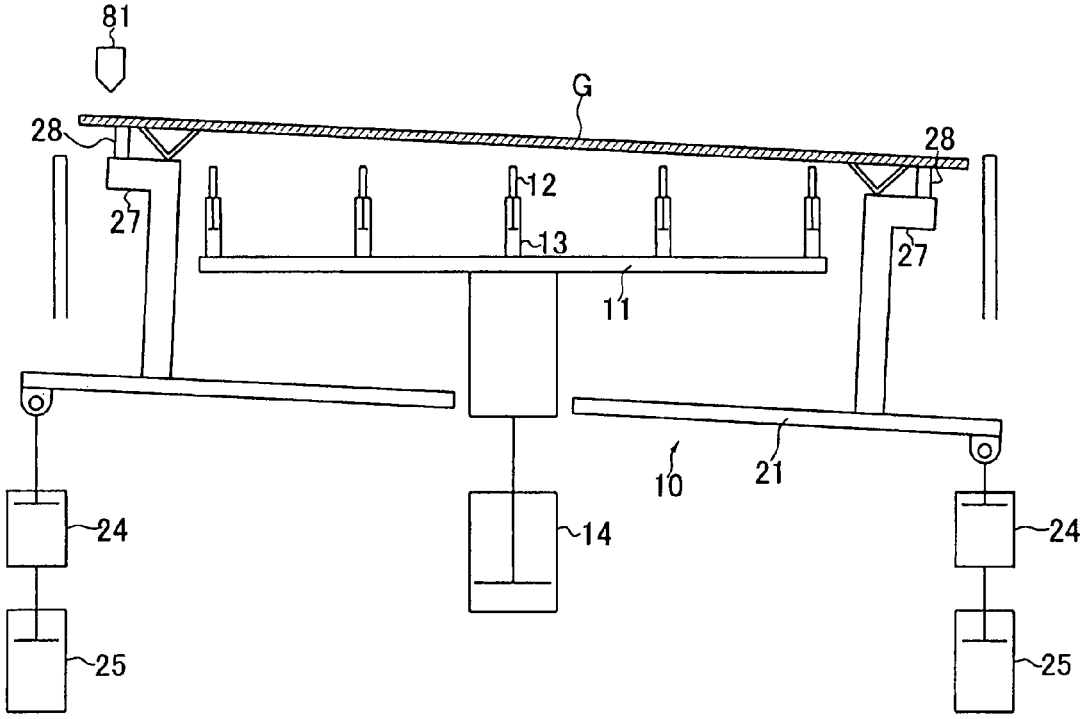
FIG. 27 is a sectional side elevational view showing the manner in which the reverse side of the substrate is cleaned by the substrate polishing apparatus according to the embodiment of the present invention.

As shown in FIG. 27, the substrate G is tilted by the tilting mechanism to lower one end portion of the substrate G and peel the one end of the substrate G off the head 40. While the substrate G is being tilted, a cleaning liquid is ejected to the upper surface of the substrate G from a cleaning nozzle 81 that is positioned above the other end portion of the substrate G which is higher than the lowered end portion. The cleaning liquid thus supplied flows down the upper surface of the substrate G by gravity. Therefore, the entire upper surface of the substrate G can be cleaned without moving the cleaning nozzle 81. Because the cleaning liquid flows along the inclined surface, the cleaning liquid does not remain on the substrate G. Thus, the substrate G is prevented from being flexed by the weight of the cleaning liquid and hence from being damaged.

The cleaned substrate G is dried by a drying mechanism. As shown in FIG. 26, if the drying mechanism comprises the drying gas nozzles 88 for ejecting drying air or a drying gas such as a drying nitrogen gas, or the like, then the drying gas nozzles 88 dry the substrate G while the drying gas nozzles 88 are moving from one end to the other of the substrate G. At this time, the drying gas nozzles 88 may move in unison with the cleaning nozzles 81. The suction cups 26 and the substrate support members 22 also present an obstacle to the movement of the drying gas nozzles 88. Therefore, when the drying gas nozzles 88 approach the suction cups 26 and the substrate support members 22, the cylinders 23 are actuated to lower the suction cups 26 and the substrate support members 22 for allowing the drying gas nozzles 88 to pass therethrough. After the drying gas nozzles 88 have passed, the cylinders 23 are actuated again to bring the suction cups 26 successively into contact with the lower surface of the substrate G and to support the substrate G.

It is possible to provide a cleaning liquid absorbing mechanism having a sponge for sliding on the cleaned surface of the substrate G to absorb the cleaning liquid thereon, or a cleaning liquid wiping mechanism having a scraper of a synthetic resin, or the like, for moving on the cleaned surface of the substrate G to wipe off the cleaning liquid thereon.

According to another cleaning and drying mechanism, the polished substrate receiver 20 incorporates a rotating mechanism for rotating the substrate G. While the substrate G is being rotated by the rotating mechanism, the cleaning liquid and the drying air are applied to the central area of the substrate G. If the substrate G is large in size, then since the substrate G rotates at a high peripheral velocity at its outer peripheral edges, the substrate G can be quickly dried without an increase in the rotational speed of the substrate G based on a combination of the high peripheral velocity with the drying gas applied to the substrate G.

Figure 28:
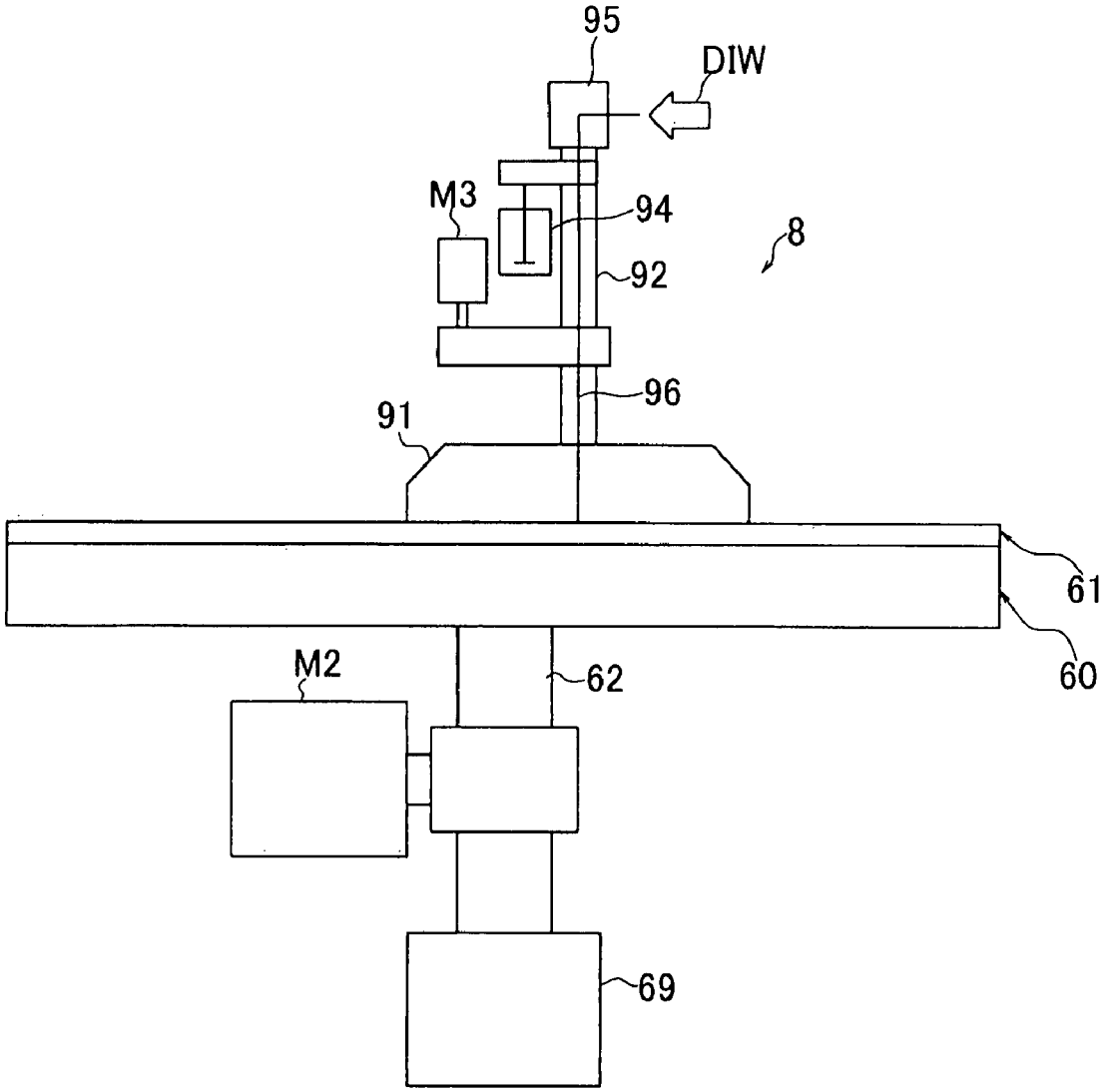
FIG. 28 is a side elevational view of the turntable and a dresser unit of the polishing mechanism in the substrate polishing apparatus according to the embodiment of the present invention.

As described above, the polishing mechanism 3 includes the dresser unit 8 for dressing the upper surface of the polishing pad 61 on the turntable 60 to form a polishing surface suitable to polish the substrate G. As shown in FIG. 1, the dresser unit 8 is mounted on a swing arm 90. As shown in FIG. 28, the dresser unit 8 comprises a dresser tool 91, a rotational shaft 92, a rotating mechanism M3, a dresser lifting and lowering mechanism 94, and a rotary water supply 95. When the swing arm 90 is turned, the dresser unit 8 moves from the position shown in FIG. 1 to a position above the turntable 60. Then, the dresser lifting and lowering mechanism 94 lowers the dresser tool 91 until the dresser tool 91 is pressed against the upper surface of the polishing pad 61. The dresser tool 91 and the turntable 60 are rotated to dress and regenerate the upper surface of the polishing pad 61.

While the upper surface of the polishing pad 61 is being dressed, the swing arm 90 is repeatedly turned to move the dresser tool 91 radially across the upper surface of the polishing pad 61. During the dressing process, pure water (DIW) supplied through the rotary water supply 95 and a pipe 96 disposed in the rotational shaft 92 is discharged from a central outlet formed in the lower surface of the dresser tool 91. The pure water discharged from the central outlet is effective to expel dust and debris produced on the polishing pad 61 by the dresser tool 91 and also to reduce the heat generated when the polishing pad 61 is dressed by the dresser tool 91.

After the polishing pad 61 on the turntable 60 is used for a predetermined period of time, it will no longer be suitable for polishing substrates even if the polishing pad 61 is dressed by the dressing tool 91. Therefore, the polishing pad 61 that has been used up needs to be replaced with a new one. For replacing the polishing pad 61, water or a chemical is supplied through the pipe 74 shown in FIG. 19 to the gap between the turntable 60 and the polishing pad 61 to facilitate removal of the polishing pad 61 from the turntable 60 under action (pressure) of the water or the chemical.

Figure 29:
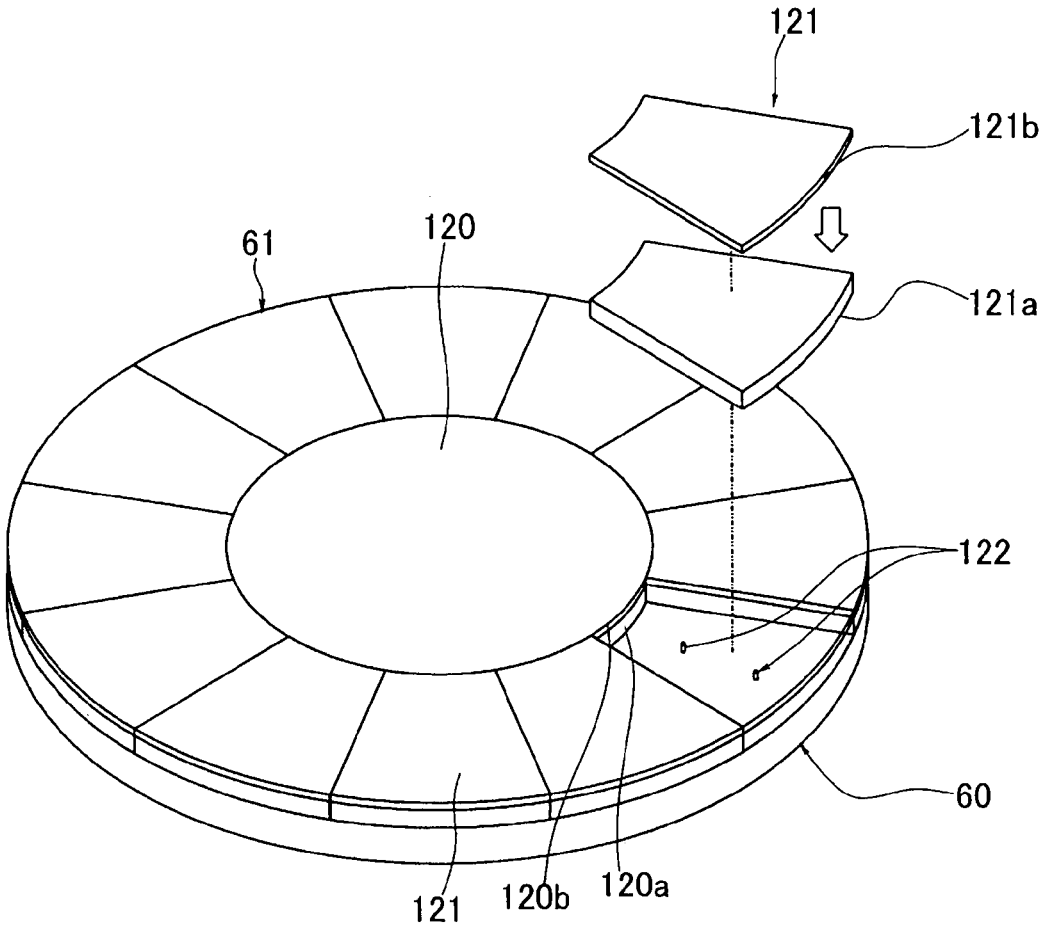
FIG. 29 is a perspective view of the turntable and the polishing pad of the polishing mechanism in the substrate polishing apparatus according to the embodiment of the present invention.

FIG. 29 shows the turntable 60 and the polishing pad 61 mounted the turntable 60. As shown in FIG. 29, the polishing pad 61 comprises a plurality of polishing pad segments including a central circular polishing pad segment 120 disposed centrally on the turntable 60 and a number of (twelve in FIG. 29) sectorial polishing pad segments 121 disposed on the turntable 60 around the central circular polishing pad segment 120. The central circular polishing pad segment 120 comprises a circular pad base 120*a* and a circular pad 120*b* bonded to the upper surface of the circular pad base 120*a*. Each of the sectorial polishing pad segments 121 comprises a sectorial pad base 121*a* and a sectorial pad 121*b* bonded to the upper surface of the sectorial pad base 121*a*. The central circular polishing pad segment 120 and the sectorial polishing pad segments 121 are positioned on and fixed to the upper surface of the turntable 60 by positioning pins 122 which are mounted on the turntable 60 and inserted in respective holes (not shown) formed in the pad bases 120*a*, 121*a*.

Because the polishing pad 61 comprises the polishing pad segment 120 and a number of the polishing pad segments 121, each of the polishing pad segment 120 and the polishing pad segments 121 can individually be replaced with a new polishing pad segment in a short period of time. If the turntable 60 is larger in diameter, then it is easier to replace the polishing pad segments 120, 121. The polishing pad segments 120, 121 have such a level of dimensional accuracy which does not impair the surface uniformity of the substrate G as the substrate G is polished by the polishing pad 61.

Figure 30:
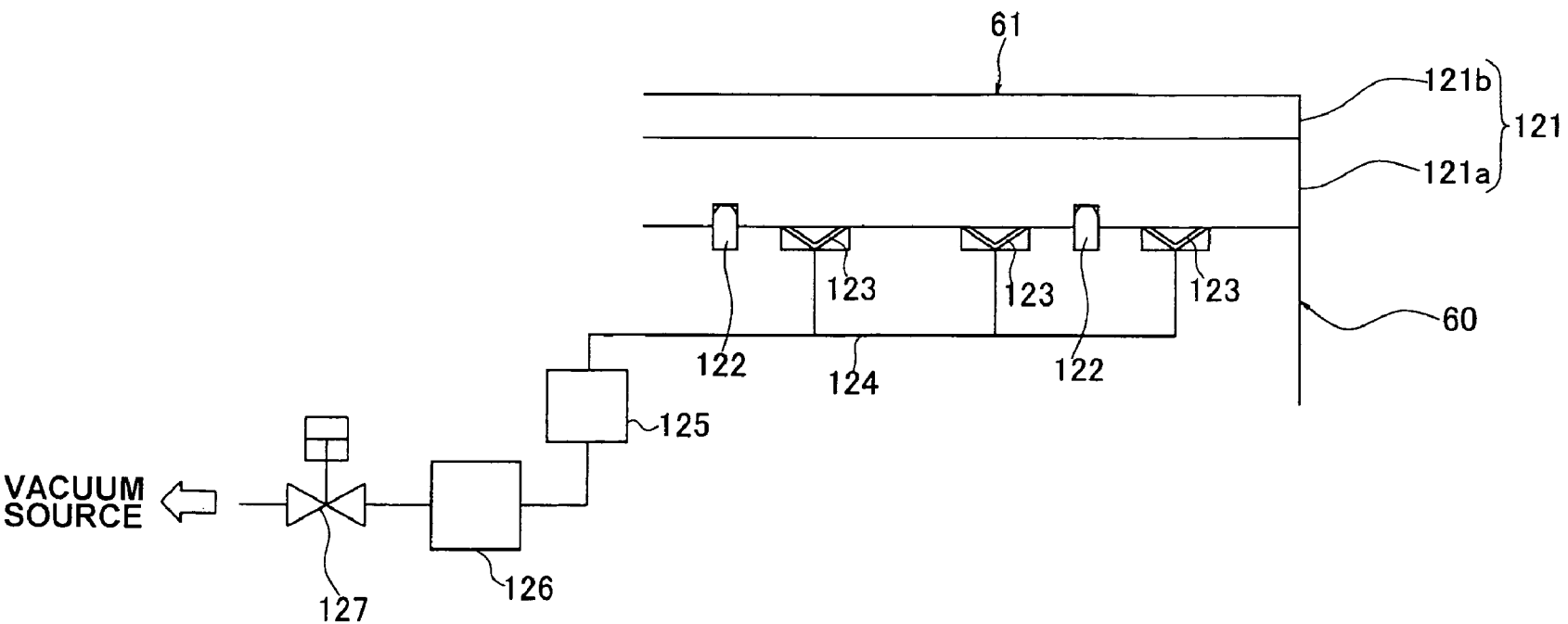
FIG. 30 is a sectional side elevational view showing an example in which the polishing pad is fixed to the turntable in the substrate polishing apparatus according to the embodiment of the present invention.

There are various ways of fixing the polishing pad segments 121 to the turntable 60. FIG. 30 shows an example in which the turntable 60 has a plurality of suction cups 123 disposed in its upper surface and connected to a vacuum line 124. The base 121*a* of each of the polishing pad segments 121 is attracted under vacuum suction by the suction cups 123, thereby fixing the polishing pad segments 121 to the turntable 60. The vacuum line 124 is connected to a liquid-gas separator 125, a vacuum sensor 126 for measuring a vacuum level in the vacuum line 124, and a valve 127. Based on monitoring the vacuum level in the vacuum line 124 by the vacuum sensor 126, it is possible to fix the polishing pad segments 121 to the upper surface of the turntable 60 under a desired vacuum attraction force and also to reduce the vacuum consumption. Although not shown in the drawing, the polishing pad segment 120 is also fixed to the upper surface of the turntable 60 in the same manner.

Figure 31:
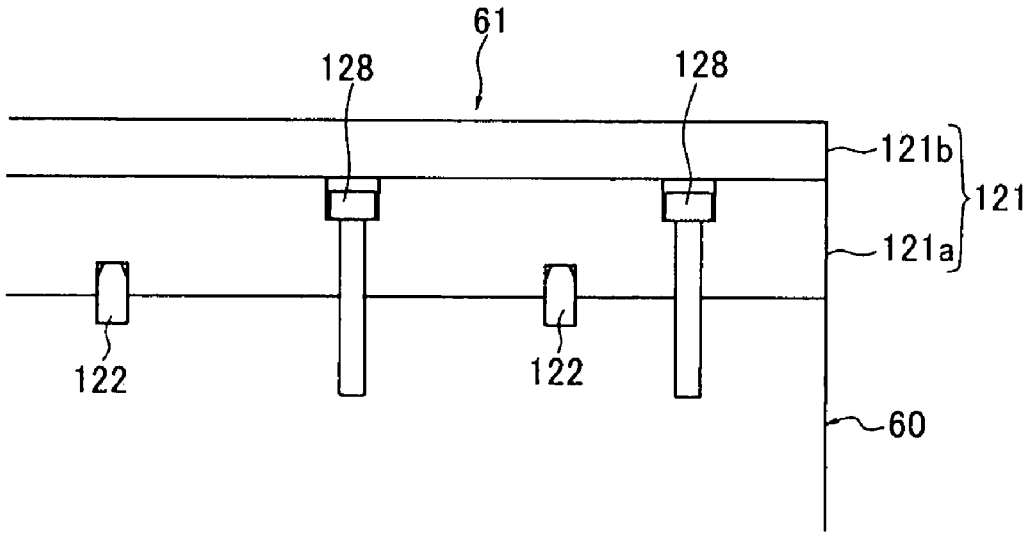
FIG. 31 is a sectional side elevational view showing another example in which the polishing pad is fixed to the turntable in the substrate polishing apparatus according to the embodiment of the present invention.
Figure 32:
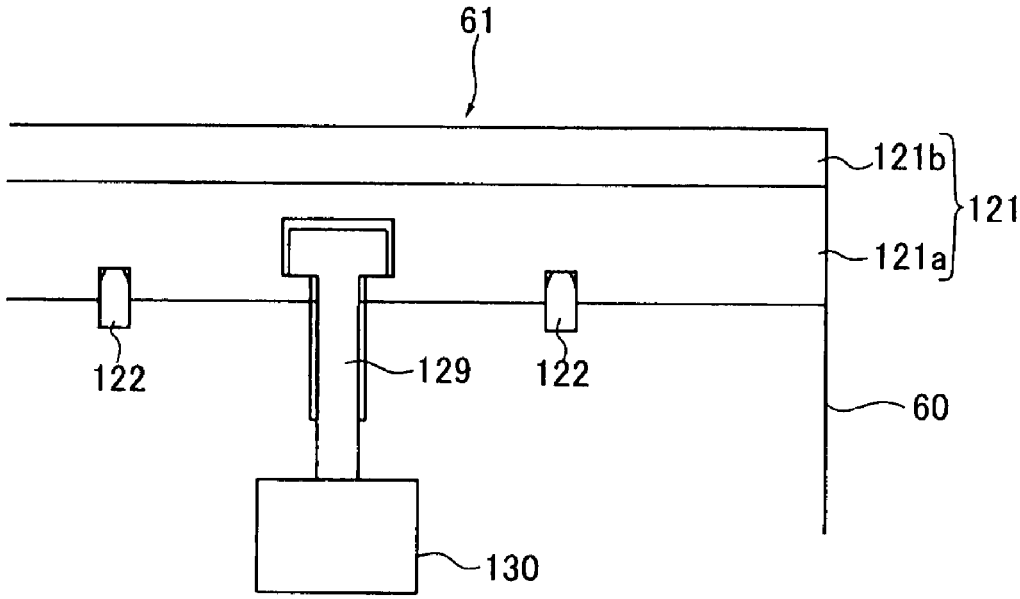
FIG. 32 is a sectional side elevational view showing still another example in which the polishing pad is fixed to the turntable in the substrate polishing apparatus according to the embodiment of the present invention.

According to another fixing method for fixing the polishing pad segments 121 to the turntable 60, as shown in FIG. 31, the base 121*a* of each of the polishing pad segments 121 is fastened to the turntable 60 by screws 128. According to still another example shown in FIG. 32, the base 121*a* of each of the polishing pad segments 121 is fastened to the turntable 60 by a bolt 129 which is attached to the base 121*a* of the polishing pad segments 121 and tightened by a rotary actuator 130. The polishing pad segment 120 may be fixed to the upper surface of the turntable 60 in the same manner.

One or more of the substrate polishing apparatuses according to the present invention may be placed along a substrate transfer region associated with substrate transfer means such as transfer robots, or the like, for example, thereby providing a substrate polishing facility. Alternatively, one or more of the substrate polishing apparatuses according to the present invention may be placed along a substrate transfer region associated with substrate transfer means, and other substrate polishing apparatuses may also be placed along the substrate transfer region, thereby providing a substrate polishing facility. Specifically, the substrate polishing apparatus according to the present invention may be used in any of various combinations to satisfy the demands of users.

In the illustrated embodiments, the substrate polishing apparatus employs the turntable 60 as a polishing table which rotates about its own axis. However, the substrate polishing apparatus may employ a polishing table which makes a translational motion such as a scrolling motion or a reciprocating motion. In the illustrated embodiments, the polishing pad 61 is mounted as a polishing tool on the upper surface of the turntable 60. However, the polishing tool may comprise a grinding wheel comprising abrasive particles bonded together by a binder. In other words, the polishing tool may be any polishing tool which can be dressed and regenerated to provide a polishing surface suitable for polishing by a polishing tool conditioner.

Although certain preferred embodiments of the present invention have been shown and described in detail, it should be understood that various changes and modifications may be made therein without departing from the scope of the appended claims.

What is claimed is:

1. A substrate polishing apparatus for polishing a substrate, said substrate polishing apparatus comprising:

a substrate holding mechanism including a head for holding the substrate;

a polishing mechanism including a polishing table having a polishing tool, the substrate held by said head being pressed against said polishing tool on said polishing table to polish the substrate by relative movement of the substrate and said polishing tool; and a substrate transfer mechanism including:

a substrate-to-be-polished receiver configured to transfer the substrate to be polished to said head; and a polished substrate receiver configured to receive the substrate which has been polished from said head, wherein said substrate-to-be-polished receiver and said polished substrate receiver are disposed coaxially with each other along an axis and movable independently of each other along the axis.

2. A substrate polishing apparatus according to claim 1, wherein said substrate transfer mechanism further includes a cleaning and drying unit for cleaning and drying the polished substrate on said polished substrate receiver.

3. A substrate polishing apparatus according to claim 1, wherein said substrate to-be-polished receiver includes a first substrate support for supporting a device area of the substrate, and said polished substrate receiver includes a second substrate support for supporting a device-free area of the substrate.

4. A substrate polishing apparatus according to claim 1, wherein said polished substrate receiver includes:

a plurality of substrate supports disposed along an outer peripheral edge of the substrate and vertically movably supported by a lifting and lowering mechanism; and a plurality of suction mechanisms mounted on said substrate supports, respectively.

5. A substrate polishing apparatus according to claim 1, wherein said polished substrate receiver includes a tilting mechanism for tilting the substrate.

6. A substrate polishing apparatus according to claim 1, further comprising:

a removing assistor comprising at least one of a string, a rod, and a plate, said at least one of the string, the rod, and the plate being movable parallel to a substrate holding surface of said polished substrate receiver by a moving mechanism.

7. A substrate polishing apparatus according to claim 1, further comprising:

a gas ejection nozzle for ejecting a gas into a gap between the substrate and said head.

8. A substrate polishing apparatus according to claim 1, wherein said polished substrate receiver includes a sealing mechanism for sealing an outer peripheral portion of the substrate.

9. A substrate polishing apparatus according to claim 2, wherein said cleaning and drying unit includes a drying mechanism for applying a gas to dry a cleaned area of the substrate.

10. A substrate polishing apparatus according to claim 2, wherein said cleaning and drying unit includes a cleaning liquid removing mechanism for absorbing or removing a cleaning liquid from a cleaned area of the substrate.

11. A substrate polishing apparatus according to claim 1, wherein said polishing table includes a plurality of fins for cooling said polishing table.

12. A substrate polishing apparatus according to claim 11, wherein said plurality of fins are further for preventing said polishing table from flexing.

13. A substrate polishing apparatus according to claim 1, wherein said polishing table further comprises a groove formed in an outer circumferential edge of said polishing table, and wherein said substrate polishing apparatus further comprises a cam follower engaging in said groove.

14. A substrate polishing apparatus according to claim 1, further comprising a displacement sensor disposed near an outer circumferential edge of said polishing table for detecting a displacement of said polishing table.

15. A substrate polishing apparatus according to claim 1, further comprising:

a plurality of slurry outlets having peripheral edges formed in an upper surface of said polishing table; and, a plurality of pressing members for pressing said polishing tool against said peripheral edges of said plurality of slurry outlets.

16. A substrate polishing apparatus according to claim 1, further comprising:

a plurality of slurry outlets formed in an upper surface of said polishing table, wherein said plurality of slurry outlets is positioned in an area of said polishing table which is held in contact with a surface to-be-polished of the substrate while the substrate is being polished.

17. A substrate polishing apparatus according to claim 1, further comprising a tube disposed on an outer circumferential portion of said polishing table for pushing an outer circumferential portion of said polishing tool off said polishing table under the pressure of a compressed gas delivered into said tube.

18. A substrate polishing apparatus according to claim 1, further comprising a gas concentration sensor disposed above said polishing table.

19. A substrate polishing apparatus according to claim 1, further comprising a dresser tool for dressing a surface of said polishing tool, said dresser tool including a water outlet for discharging water.

20. A substrate polishing apparatus according to claim 1, wherein said polishing tool comprises a polishing pad mounted on an upper surface of said polishing table, and wherein said polishing table includes an outlet for discharging at least one of water and a chemical between said polishing table and said polishing pad.

21. A substrate polishing apparatus according to claim 1, further comprising a gas outlet formed in an upper surface of said polishing tool for discharging a gas.

22. A substrate polishing apparatus according to claim 1, wherein said polishing tool comprises a plurality of plate-like segments mounted on an upper surface of said polishing table, said plurality of plate-like segments being fixed to said upper surface of said polishing table by vacuum suction or by a mechanical fixing member.

23. A substrate polishing apparatus according to claim 1, wherein the substrate held by said head is cleaned after being polishing while said head is moving from said polishing table to a location above said polished substrate receiver.

* * * * *